US008618951B2

(12) United States Patent
Popovic

(10) Patent No.: US 8,618,951 B2
(45) Date of Patent: Dec. 31, 2013

(54) TRAFFIC CONTROL DATABASE AND DISTRIBUTION SYSTEM

(75) Inventor: Zeljko Popovic, Royal Oak, MI (US)

(73) Assignee: Honda Motor Co., Ltd., Tokyo (JP)

( * ) Notice: Subject to any disclaimer, the term of this patent is extended or adjusted under 35 U.S.C. 154(b) by 204 days.

(21) Appl. No.: 12/884,659

(22) Filed: Sep. 17, 2010

(65) Prior Publication Data

US 2012/0068860 A1 Mar. 22, 2012

(51) Int. Cl.
*G08G 1/09* (2006.01)

(52) U.S. Cl.
USPC ..... 340/905; 340/995.1; 340/909

(58) Field of Classification Search
USPC ..... 340/905, 906, 995.1, 995.19, 995.2, 340/907, 929, 909
See application file for complete search history.

(56) References Cited

U.S. PATENT DOCUMENTS

| | | | | |
|---|---|---|---|---|
| 5,289,181 | A | 2/1994 | Watanabe et al. | |
| 5,485,161 | A | 1/1996 | Vaughn | |
| 5,539,398 | A | 7/1996 | Hall et al. | |
| 5,939,976 | A | 8/1999 | Sasaki et al. | |
| 5,940,010 | A | 8/1999 | Sasaki et al. | |
| 5,999,878 | A | 12/1999 | Hanson et al. | |
| 6,047,234 | A | 4/2000 | Cherveny et al. | |
| 6,163,750 | A | 12/2000 | Nojima | |
| 6,169,495 | B1 | 1/2001 | Koike | |
| 6,307,484 | B1 | 10/2001 | Sasaki et al. | |
| 6,317,058 | B1 * | 11/2001 | Lemelson et al. | 340/910 |
| 6,356,840 | B2 | 3/2002 | Kusama | |
| 6,370,475 | B1 | 4/2002 | Breed et al. | |
| 6,385,539 | B1 | 5/2002 | Wilson et al. | |
| 6,405,128 | B1 | 6/2002 | Bechtolsheim et al. | |
| 6,405,132 | B1 | 6/2002 | Breed et al. | |
| 6,516,267 | B1 | 2/2003 | Cherveny et al. | |
| 6,516,273 | B1 | 2/2003 | Pierowicz et al. | |
| 6,526,348 | B1 | 2/2003 | McDonough | |
| 6,526,352 | B1 | 2/2003 | Breed et al. | |
| 6,624,782 | B2 | 9/2003 | Jocoy et al. | |

(Continued)

FOREIGN PATENT DOCUMENTS

| | | |
|---|---|---|
| JP | 2005006081 | 1/2005 |
| JP | 2005165643 | 6/2005 |

(Continued)

OTHER PUBLICATIONS

Notification of the Transmittal of The International Search Report and the Written Opinion of the International Searching Authority, or The Declaration mailed in PCT Application No. PCT/US2010/051761.

(Continued)

*Primary Examiner* — Daniel Previl
(74) *Attorney, Agent, or Firm* — Plumsea Law Group, LLC

(57) ABSTRACT

A database for storing intersection data efficiently is disclosed. The database stores two or more points for each approach to the intersection along with the intersection control type. A third point can be used to help define the geometry of each approach. The database can be used with a warning system or any other vehicle system. The system may use approach point and intersection control type information to provide warnings to drivers of the motor vehicle when the motor vehicle is approaching the intersection at such a speed that the motor vehicle cannot safely stop. Methods for distributing the database information are also disclosed. The methods include pre-installed databases, dealer installed databases and on-demand distribution of intersection information.

19 Claims, 16 Drawing Sheets

(56) References Cited

U.S. PATENT DOCUMENTS

| | | | | |
|---|---|---|---|---|
| 6,640,188 | B2 | 10/2003 | Hashida | |
| 6,658,356 | B2 | 12/2003 | Chen et al. | |
| 6,720,920 | B2 | 4/2004 | Breed et al. | |
| 6,735,515 | B2 | 5/2004 | Bechtolsheim et al. | |
| 6,763,301 | B2 | 7/2004 | McDonough | |
| 6,768,944 | B2 | 7/2004 | Breed et al. | |
| 6,810,327 | B2 | 10/2004 | Akashi | |
| 6,816,779 | B2 | 11/2004 | Chen et al. | |
| 6,836,781 | B2 | 12/2004 | McDonough | |
| 6,853,913 | B2 | 2/2005 | Cherveny et al. | |
| 6,859,731 | B2 | 2/2005 | Takafuji et al. | |
| 6,865,479 | B2 | 3/2005 | Chen et al. | |
| 6,868,410 | B2 | 3/2005 | Fortin et al. | |
| 7,046,827 | B2 | 5/2006 | Chen et al. | |
| 7,072,764 | B2 | 7/2006 | Donath et al. | |
| 7,079,946 | B2 | 7/2006 | Hunzinger | |
| 7,085,637 | B2 | 8/2006 | Breed et al. | |
| 7,102,496 | B1 | 9/2006 | Ernst, Jr. et al. | |
| 7,110,880 | B2 | 9/2006 | Breed et al. | |
| 7,124,025 | B2 | 10/2006 | Okada et al. | |
| 7,124,027 | B1 | 10/2006 | Ernst, Jr. et al. | |
| 7,133,775 | B2 * | 11/2006 | Adamski et al. | 701/438 |
| 7,151,467 | B2 | 12/2006 | Fujita et al. | |
| 7,194,347 | B2 | 3/2007 | Harumoto et al. | |
| 7,202,776 | B2 | 4/2007 | Breed | |
| 7,209,051 | B2 | 4/2007 | Shankwitz et al. | |
| 7,295,925 | B2 | 11/2007 | Breed et al. | |
| 7,317,406 | B2 | 1/2008 | Wolterman | |
| 7,406,381 | B2 | 7/2008 | Obata | |
| 7,418,346 | B2 | 8/2008 | Breed et al. | |
| 7,426,437 | B2 | 9/2008 | Breed et al. | |
| 7,433,889 | B1 | 10/2008 | Barton | |
| 7,440,830 | B2 | 10/2008 | Isaji et al. | |
| 7,440,850 | B2 | 10/2008 | Kim | |
| 7,486,202 | B2 | 2/2009 | Konishi et al. | |
| 7,519,472 | B1 | 4/2009 | Grigsby et al. | |
| 7,565,231 | B2 * | 7/2009 | Sherony et al. | 701/45 |
| 7,720,026 | B2 | 5/2010 | Chen et al. | |
| 2003/0016143 | A1 * | 1/2003 | Ghazarian | 340/901 |
| 2003/0134645 | A1 | 7/2003 | Stern et al. | |
| 2004/0236543 | A1 | 11/2004 | Stephens | |
| 2005/0033505 | A1 | 2/2005 | Zatz | |
| 2005/0143889 | A1 | 6/2005 | Isaji et al. | |
| 2006/0173611 | A1 | 8/2006 | Takagi et al. | |
| 2007/0005609 | A1 | 1/2007 | Breed | |
| 2007/0013497 | A1 | 1/2007 | Watanabe | |
| 2007/0021915 | A1 | 1/2007 | Breed et al. | |
| 2007/0027583 | A1 | 2/2007 | Tamir et al. | |
| 2007/0073463 | A1 | 3/2007 | Sherony et al. | |
| 2007/0124067 | A1 | 5/2007 | Kim et al. | |
| 2007/0171095 | A1 | 7/2007 | Mochizuki | |
| 2007/0208493 | A1 | 9/2007 | Downs et al. | |
| 2007/0208494 | A1 | 9/2007 | Chapman et al. | |
| 2007/0208495 | A1 | 9/2007 | Chapman et al. | |
| 2007/0208496 | A1 | 9/2007 | Downs et al. | |
| 2007/0208501 | A1 | 9/2007 | Downs et al. | |
| 2007/0276600 | A1 | 11/2007 | King et al. | |
| 2007/0280503 | A1 | 12/2007 | Kubota et al. | |
| 2007/0282532 | A1 | 12/2007 | Yamamoto et al. | |
| 2008/0004615 | A1 | 1/2008 | Woloszko et al. | |
| 2008/0015771 | A1 | 1/2008 | Breed et al. | |
| 2008/0015772 | A1 | 1/2008 | Sanma et al. | |
| 2008/0021641 | A1 | 1/2008 | Kim | |
| 2008/0024323 | A1 | 1/2008 | Kadaba | |
| 2008/0040023 | A1 | 2/2008 | Breed et al. | |
| 2008/0040029 | A1 | 2/2008 | Breed | |
| 2008/0040032 | A1 | 2/2008 | Ohashi | |
| 2008/0042815 | A1 | 2/2008 | Breed et al. | |
| 2008/0071465 | A1 | 3/2008 | Chapman et al. | |
| 2008/0106436 | A1 | 5/2008 | Breed | |
| 2008/0120025 | A1 | 5/2008 | Naitou et al. | |
| 2008/0128190 | A1 | 6/2008 | Tsutsumi et al. | |
| 2008/0133136 | A1 | 6/2008 | Breed et al. | |
| 2008/0140318 | A1 | 6/2008 | Breed | |
| 2008/0147253 | A1 | 6/2008 | Breed | |
| 2008/0150786 | A1 | 6/2008 | Breed | |
| 2008/0154495 | A1 | 6/2008 | Breed | |
| 2008/0154629 | A1 | 6/2008 | Breed et al. | |
| 2008/0161986 | A1 | 7/2008 | Breed | |
| 2008/0161987 | A1 | 7/2008 | Breed | |
| 2008/0162036 | A1 | 7/2008 | Breed | |
| 2008/0165018 | A1 | 7/2008 | Breed | |
| 2008/0167819 | A1 | 7/2008 | Breed | |
| 2008/0167821 | A1 | 7/2008 | Breed | |
| 2008/0215202 | A1 | 9/2008 | Breed | |
| 2008/0215231 | A1 | 9/2008 | Breed | |
| 2008/0243378 | A1 | 10/2008 | Zavoli | |
| 2009/0030605 | A1 | 1/2009 | Breed | |
| 2009/0033540 | A1 | 2/2009 | Breed et al. | |
| 2009/0043497 | A1 | 2/2009 | Tashev et al. | |
| 2009/0043506 | A1 | 2/2009 | Breed | |
| 2009/0048750 | A1 | 2/2009 | Breed | |
| 2009/0070031 | A1 | 3/2009 | Ginsberg | |
| 2009/0082917 | A1 | 3/2009 | Adachi | |
| 2009/0182497 | A1 * | 7/2009 | Hagiwara | 701/201 |
| 2009/0198441 | A1 * | 8/2009 | Kumagai et al. | 701/117 |
| 2009/0224942 | A1 | 9/2009 | Goudy et al. | |
| 2010/0106413 | A1 | 4/2010 | Mudalige | |

FOREIGN PATENT DOCUMENTS

| | | |
|---|---|---|
| JP | 2005182310 | 7/2005 |
| JP | 2005242943 | 9/2005 |
| JP | 2006011607 | 1/2006 |
| JP | 2007141114 | 6/2007 |
| JP | 2007200052 | 8/2007 |
| JP | 2007279004 | 10/2007 |
| JP | 2007328573 | 12/2007 |
| JP | 2008009870 | 1/2008 |
| JP | 2008062787 | 3/2008 |
| JP | 2008101458 | 5/2008 |
| JP | 2008132894 | 6/2008 |
| JP | 2008198162 | 8/2008 |
| JP | 2008276688 | 11/2008 |
| JP | 2009031837 | 2/2009 |

OTHER PUBLICATIONS

International Search Report and Written Opinion mailed Apr. 20, 2012 in International Application No. PCT/US2012/021844.

International Preliminary Report on Patentability (including Written Opinion of the ISA) mailed Apr. 19, 2012 in International Application No. PCT/US2010/051761.

International Search Report and Written Opinion mailed Dec. 12, 2011 in International Application No. PCT/US2010/60695.

International Preliminary Report on Patentability (including Written Opinion of the ISA) mailed Aug. 1, 2013 in International Application No. PCT/US2012/021844.

Japanese Office Action dated Aug. 6, 2013 in Japanese Patent Application No. 2012-544815.

* cited by examiner

502

| AREA ID | DATE | BOUNDARY | # INTERSECTIONS | PARENT AREA |
|---|---|---|---|---|
| 1 | 5/10/2010 | --- | 0 | A |
| 2 | 5/10/2010 | --- | 1 | A |

506

| INTERSECTION ID | APPROACH ID | TYPE | INNER LAT. OFFSET | INNER LON. OFFSET | FIRST OUTER LAT. OFFSET | FIRST OUTER LON. OFFSET | SECOND OUTER LAT. OFFSET | SECOND OUTER LON. OFFSET |
|---|---|---|---|---|---|---|---|---|
| 1 | 1 | STOP-SIGN | -3.0 | -7.0 | -3.0 | -57.0 | 0.0 | 0.0 |
| 1 | 2 | RIGHT-OF-WAY | -7.0 | 3.0 | -57.0 | 3.0 | 0.0 | 0.0 |
| 1 | 3 | STOP-SIGN | 3.0 | 7.0 | 3.0 | 57.0 | 0.0 | 0.0 |
| 1 | 4 | RIGHT-OF-WAY | 7.0 | -3.0 | 57.0 | -3.0 | 0.0 | 0.0 |
| 2 | 1 | STOP-SIGN | -1.6 | -23.6 | -3.6 | -87.4 | 0.0 | 0.0 |
| 2 | 2 | STOP-SIGN | -16.6 | 2.6 | -63.4 | 14.0 | -153.2 | 66.4 |
| 2 | 3 | STOP-SIGN | 5.2 | 14.9 | 7.2 | 137.4 | 0.0 | 0.0 |
| 2 | 4 | STOP-SIGN | 19.7 | -8.6 | 108.6 | -7.5 | 0.0 | 0.0 |

TRAFFIC CONTROL DATABASE AND DISTRIBUTION SYSTEM

BACKGROUND OF THE INVENTION

1. Field of the Invention

The present invention relates to motor vehicles and in particular to a traffic control database and distribution system for use with a motor vehicle.

2. Description of Related Art

There have been systems developed to help prevent stop-sign violations. Those systems may be classified into map-based systems, camera-based systems; and Vehicle-to-Infrastructure communication based (V2I based).

Map-based systems may use a navigation system such as those based on Global Positioning System (GPS), to continually locate the vehicle on a map. The map may also be supplemented with information on traffic signs, including locations of stop-signs. Map-based systems may recognize that a vehicle is approaching a stop-sign controlled intersection and generate a warning if corrective action is warranted.

Camera-based systems use cameras to recognize signs and react to likely violations.

V2I-based systems such as the Crash Avoidance Metrics Partnership (CAMP) consortium's Cooperative Intersection Collision Avoidance System Limited to Stop Sign and Traffic Signal Violations (CICAS-V), may rely on communication between units associated with the road infrastructure and vehicles to generate a warning. In these systems, the road infrastructure may transmit, among other information, detailed geometry maps of stop-sign equipped intersections in the area. Vehicles may receive and store these maps. Further, the vehicles may continually monitor their own location and when they detect that they are approaching a stop-sign intersection without the driver's intending to stop, a warning may be generated, or a corrective action may be issued.

Map-based systems may require specially supplementing the maps with traffic sign information, including sign location. Such systems may offer only limited geographic coverage or become out of date.

Camera-based systems require camera equipment. The performance of camera equipment degrades in certain conditions such as light extremes, fog, rain, and snow. Cameras are also limited by their line of sight. Performance degrades when signs are visually obstructed, e.g., by trees or other vehicles.

Required infrastructure of V2I solutions does not generally exist, being only available in prototype environments limited to neighborhoods of a handful of communities. It is widely believed that the investment required by government bodies to develop and install the infrastructure is likely to significantly lag V2V communication deployment by one or more original equipment manufacturers (OEMs, i.e., automakers).

SUMMARY OF THE INVENTION

A database for storing traffic control information efficiently is disclosed. The database stores two or more points for each approach to an intersection. In some cases, a third approach point may be used to help define the geometry of the intersection. The database information may be distributed through various methods. In some cases, the database information may be built into the vehicle during manufacturing. In other cases, the database information may be loaded into a vehicle system by a dealer. In still other cases, the database information may be shared among multiple vehicles based on geographic demand. The database can also be used with a warning system to help provide warnings to a driver upon approaches to an intersection controlled by stop-signs.

In one aspect, the invention provides a motor vehicle, comprising: a traffic control database configured to store traffic control information; the traffic control information including information related to an approach to an intersection; the approach being stored as a first approach point and a second approach point, the first approach point being associated with an entrance to the intersection; and where a direction of the approach is defined by the second approach point.

In another aspect, the invention provides a method for updating traffic control information in a traffic control database for a motor vehicle comprising the steps of: retrieving a location; receiving information concerning the date of the latest available traffic control information for the location; comparing the date of the latest available traffic control information with the date of current traffic control information stored in the traffic control database; and receiving traffic control information if the latest available traffic control information is more recent than the current traffic control information stored in the traffic control database.

In another aspect, the invention provides a motor vehicle, comprising: a warning system including a warning interface; a GPS receiver; a traffic control database configured to store traffic control information; the traffic control information including information related to an approach to an intersection; the approach being stored as a first approach point and a second approach point, the first approach point being associated with an entrance to the intersection and where a direction of the approach is defined by the second approach point; and where the warning system determines whether to issue a warning through the warning interface according to the position of the motor vehicle with respect to the first approach point and the second approach point, and stopping distance information.

Other systems, methods, features and advantages of the invention will be, or will become, apparent to one of ordinary skill in the art upon examination of the following figures and detailed description. It is intended that all such additional systems, methods, features and advantages included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE EXEMPLARY EMBODIMENTS

Figure 1:
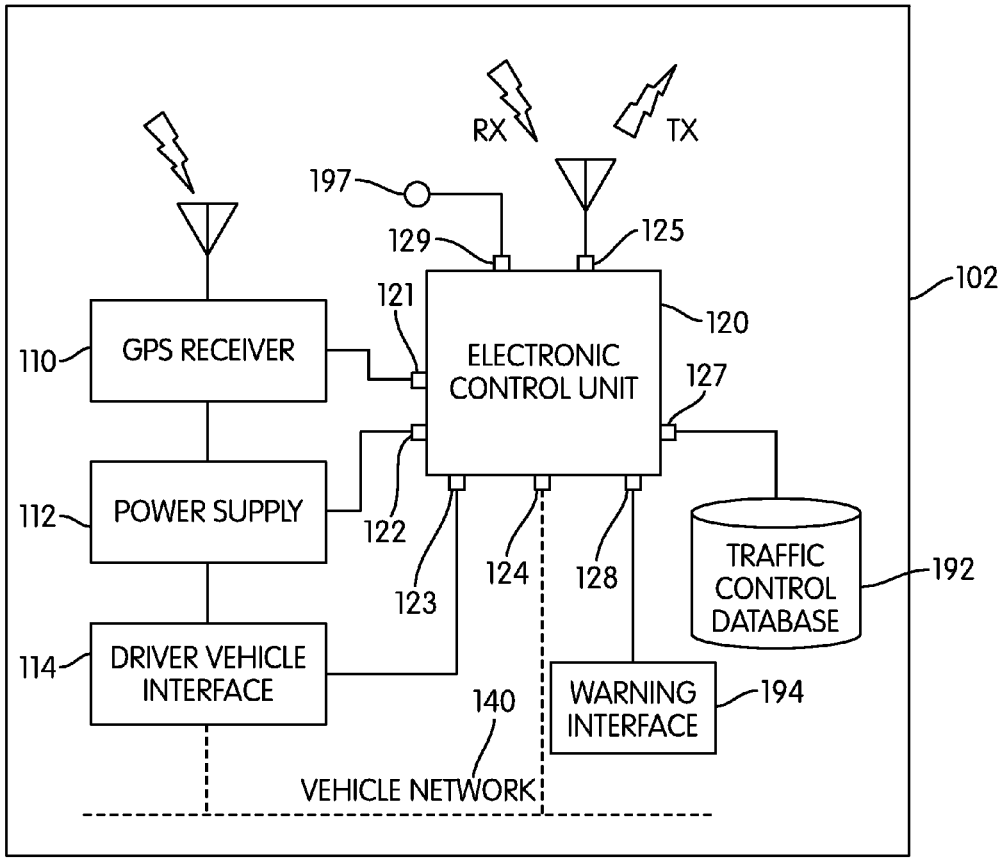
FIG. 1 is a schematic view of an embodiment of motor vehicle with a traffic control database.

FIG. 1 is a schematic view of a motor vehicle 102 according to an embodiment of the invention. The term "motor vehicle" as used throughout the specification and claims refers to any moving vehicle that is capable of carrying one or more human occupants and is powered by any form of energy. The term "motor vehicle" includes, but is not limited to: cars, trucks, vans, minivans, SUVs, motorcycles, scooters, boats, personal watercraft, and aircraft.

In some cases, the motor vehicle includes one or more engines. The term "engine" as used throughout the specification and claims refers to any device or machine that is capable of converting energy. In some cases, potential energy is converted to kinetic energy. For example, energy conversion can include a situation where the chemical potential energy of a fuel or fuel cell is converted into rotational kinetic energy or where electrical potential energy is converted into rotational kinetic energy. Engines can also include provisions for converting kinetic energy into potential energy. For example, some engines include regenerative braking systems where kinetic energy from a drive train is converted into potential energy. Engines can also include devices that convert solar or nuclear energy into another form of energy. Some examples of engines include, but are not limited to: internal combustion engines, electric motors, solar energy converters, turbines, nuclear power plants, and hybrid systems that combine two or more different types of energy conversion processes.

For purposes of clarity, only some components of motor vehicle 102 may be shown. Furthermore, in other embodiments, additional components can be added or removed.

Motor vehicle 102 can include provisions for receiving GPS information. In some cases, motor vehicle 102 can include GPS receiver 110. In an exemplary embodiment, GPS receiver 110 can be used for gathering GPS information for any systems of a motor vehicle, including, but not limited to: GPS based navigation systems.

Motor vehicle 102 can include provisions for powering one or more devices. In some cases, motor vehicle 102 can include power supply 112. Generally, power supply 112 can be any type of power supply associated with a motor vehicle. In some cases, power supply 112 can be a car battery. In other cases, power supply 112 can be another type of power supply available within motor vehicle 102.

Motor vehicle 102 can include provisions for communicating with a driver. In some embodiments, motor vehicle 102 can include driver vehicle interface 114. In some cases, driver vehicle interface 114 can include provisions for transmitting information to a driver and/or passenger. In other cases, driver vehicle interface 114 can include provisions for receiving information from a driver and/or passenger. In an exemplary embodiment, driver vehicle interface 114 can include provisions for transmitting and receiving information from a driver and/or passenger.

Motor vehicle 102 may include provisions for communicating, and in some cases controlling, the various components associated with motor vehicle 102. In some embodiments, motor vehicle 102 may be associated with a computer or similar device. In the current embodiment, motor vehicle 102 may include electronic control unit 120, hereby referred to as ECU 120. In one embodiment, ECU 120 may be configured to communicate with, and/or control, various components of motor vehicle 102. In addition, in some embodiments, ECU 120 may be configured to control additional components of a motor vehicle that are not shown.

ECU 120 may include a number of ports that facilitate the input and output of information and power. The term "port" as used throughout this detailed description and in the claims refers to any interface or shared boundary between two conductors. In some cases, ports can facilitate the insertion and removal of conductors. Examples of these types of ports include mechanical connectors. In other cases, ports are interfaces that generally do not provide easy insertion or removal. Examples of these types of ports include soldering or electron traces on circuit boards.

All of the following ports and provisions associated with ECU 120 are optional. Some embodiments may include a given port or provision, while others may exclude it. The following description discloses many of the possible ports and provisions that can be used, however, it should be kept in mind that not every port or provision must be used or included in a given embodiment.

In some embodiments, ECU 120 can include first port 121 for communicating with GPS receiver 110. In particular, ECU 120 may be configured to receive GPS information from GPS receiver 110. In addition, ECU 120 can include second port 122 for receiving power from power supply 112. Also, ECU 120 can include third port 123 for communicating with driver vehicle interface 114. In particular, ECU 120 can be configured to transmit information to driver vehicle interface 114, as well as to receive information from driver vehicle interface 114.

A motor vehicle can include provisions for communicating with one or more vehicles using a vehicle communication network. The term "vehicle communication network" as used throughout this detailed description and in the claims refers to any network using motor vehicles and roadside units as nodes. Vehicle communication networks may be used for exchanging various types of information between motor vehicles and/or roadside units. An example of such a vehicular communication network is a dedicated short range communication (DSRC) network, which may be governed by SAE J2735, IEEE 1609 as well as 802.11 standards. In some cases, a vehicle communication network, such as a DSRC network, may be configured to operate in the 5.9 GHz band with bandwidth of approximately 75 MHz. In other cases, a vehicle communication network can operate in any other band and may have any bandwidth. Furthermore, in some cases, a vehicle communication network may have a range of approximately 1000 meters. In other cases, the range of a vehicle communication network can be greater than 1000 meters. In still other cases, the range of a vehicle communication network can be less than 1000 meters.

In some embodiments, ECU 120 may include fifth port 125 that is configured to communicate with one or more DSRC devices. In an exemplary embodiment, fifth port 125 may be associated with a DSRC antenna that is configured to transmit and/or receive vehicle information over one or more vehicle communication networks.

ECU 120 can include provisions for receiving information related to a vehicle speed. In one embodiment, ECU 120 may include port 129 for receiving information from vehicle speed sensor 197. Vehicle speed sensor 197 can be any type of speed sensor including a wheel sensor or any other kind of speed sensor.

In some cases, ECU 120 may include additional ports for communicating directly with one or more additional devices of a motor vehicle, including various sensors or systems of the motor vehicle. In an exemplary embodiment, ECU 120 may include fourth port 124 for communicating with onboard vehicle network 140, which comprises a network between various components and/or systems onboard of motor vehicle 102. By providing communication between ECU 120 and onboard vehicle network 140, ECU 120 may have access to additional information concerning motor vehicle 102. For instance, in some cases, ECU 120 may be configured to receive information related to various operating conditions of a motor vehicle. Examples of information that may be received via onboard vehicle network 140 include, but are not limited to: vehicle speed, engine speed, braking conditions, as well as other parameters associated with the operating condition of motor vehicle 102.

Motor vehicle 102 can include provisions for storing various kinds of information. In some cases, motor vehicle 102 may include one or more databases. The term "database" is used to describe any kind of storage device including, but not limited to: magnetic, optical, magneto-optical, and/or memory, including volatile memory and non-volatile memory. In the current embodiment, motor vehicle 102 may include traffic control database 192.

Traffic control database 192 may be used to store information related to various types of traffic control signs or devices. The term "traffic control" refers to any system or method for controlling the flow of traffic through an intersection. Examples of traffic control signs include, but are not limited to stop-signs and yield signs. In addition, traffic control devices can include traffic lights or signals. In one embodiment, traffic control database 192 may be a stop-sign database that includes information related to the location of stop-signs at various intersections.

Databases can be integral with ECU 120 or may be separate from ECU 120. In the current embodiment, traffic control database 192 may be a separate database. In one embodiment, ECU 120 may include port 127 for communicating with map database 192.

In some embodiments, motor vehicle 102 can be associated with a warning system. A warning system may be configured to provide information and/or warnings to a driver about any potentially dangerous driving conditions. For example, in some cases a warning system may be configured to warn a driver about threats of a collision with a vehicle upon passing through an intersection. In other cases, a warning system can be used to warn a driver of a potential stop-sign violation. In still other cases, a warning system can be used to warn a driver of a potential traffic signal violation.

A warning system may be integrated into ECU 120. In some cases, a warning system may be associated with an interface of some kind. In one embodiment, motor vehicle 102 includes warning interface 194. Warning interface 194 may communicate with ECU 120 through port 128.

In some cases, warning interface 194 may be a visual indicator of some kind that alerts a driver of a potential danger. In other cases, warning interface 194 can be an audible indicator that audibly warns a driver. Moreover, in some embodiments, warning interface 194 may be integral with driver vehicle interface 114. For example, in some cases, driver vehicle interface 114 may be a touch-sensitive screen for providing and receiving navigation information. In such cases, interface 114 could also be used for providing visual warnings and/or alerts to a driver.

A motor vehicle can include provisions for compactly storing information related to one or more traffic control signs or devices. In some cases, a traffic control database can be used to store information related to the locations of one or more traffic control signs. In some cases, a traffic control database can be used to store information related to one or more approaches of an intersection associated with a traffic control sign.

Figure 2:
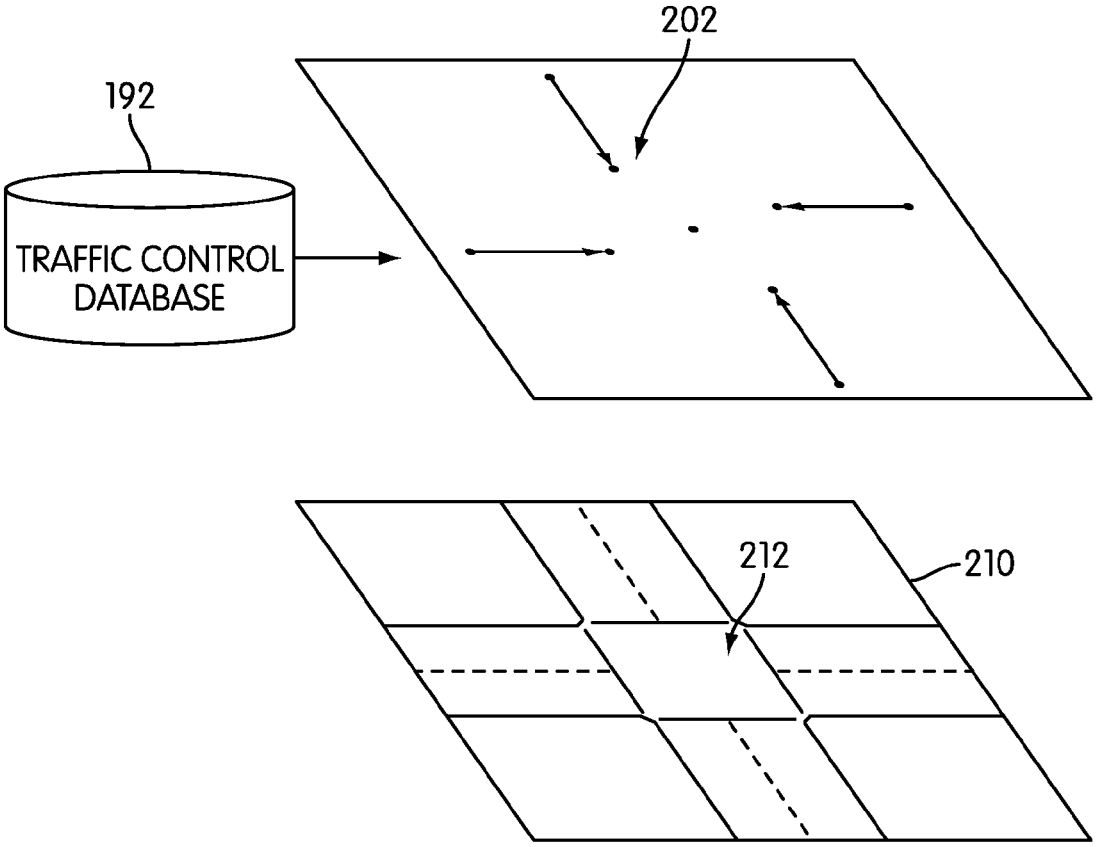
FIG. 2 is a schematic view of an embodiment of traffic control information that may be stored in a traffic control database.

FIG. 2 illustrates a schematic view of an embodiment of traffic control information that may be stored in traffic control database 192. Referring to FIG. 2, traffic control database 192 may include information that is associated with one or more traffic control signs. For example, in some cases, traffic control database 192 may store traffic control information 202. Traffic control information 202 can include any information related to the location of one or more traffic control signs or devices, as well as the direction and/or geometry of approaches associated with the traffic control signs or devices.

In the current embodiment, traffic control information 202 may be associated with map portion 210. Map portion 210 is intended to schematically represent intersection 212. In particular, traffic control information 202 uses a collection of points to represent various features of intersection 212 as discussed in detail below. Using this arrangement, traffic control information 202 may be stored compactly without requiring detailed navigation information about roadways and intersections.

Figure 3:
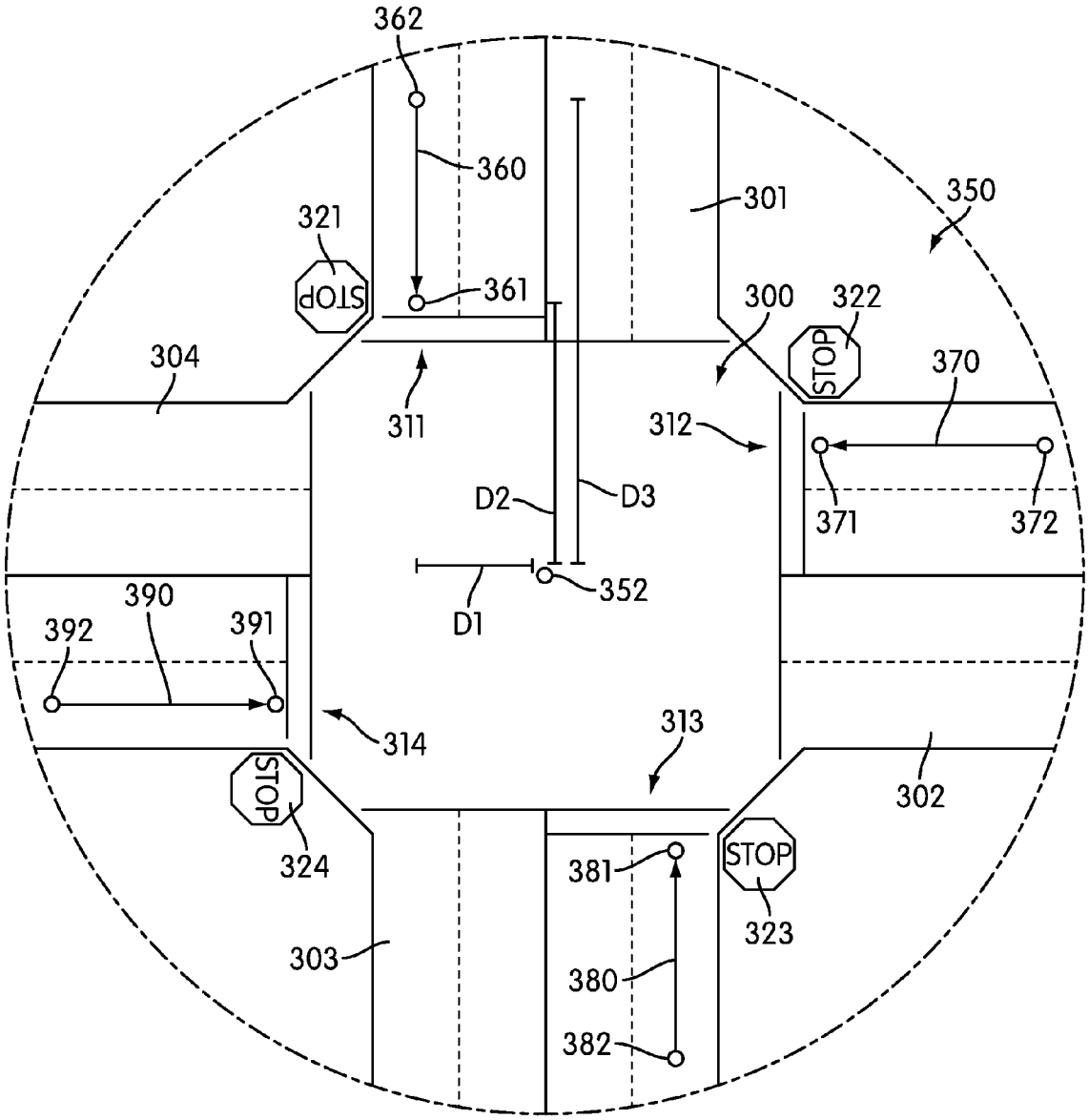
FIG. 3 is a schematic view of an embodiment of an intersection in which approaches to the intersection are defined by two approach points.

FIG. 3 illustrates an embodiment of a method of representing traffic control information associated with one or more traffic control signs at an intersection. Referring to FIG. 3, intersection 300 is associated with the intersection of first roadway 301, second roadway 302, third roadway 303 and fourth roadway 304. Intersection 300 also include first entrance 311, second entrance 312, third entrance 313 and fourth entrance 314 associated with first roadway 301, second roadway 302, third roadway 303 and fourth roadway 304, respectively. In addition, intersection 300 is associated with four stop-signs including first stop sign 321, second stop sign 322, third stop sign 323 and fourth stop-sign 324 that control the flow of traffic through first entrance 311, second entrance 312, third entrance 313 and fourth entrance 314, respectively.

For purposes of understanding the construction of a traffic control database, traffic control information 350 has been superimposed onto intersection 300. Traffic control information 350 may include center point 352 that represents the approximate geometric center of intersection 300. In some cases, center point 352 may be stored as a longitude and latitude coordinate. In other cases, center point 352 could be stored as a point using any other coordinate system. Moreover, in some cases, a center point may be stored using longitude, latitude and altitude coordinates. This may allow a system to distinguish between two intersections that may overlap in the longitude and latitude coordinates. For example, in cases where one intersection occurs on an overpass that is disposed over another intersection, the altitude coordinate could be used to distinguish the two center points of the intersections.

Traffic control information 350 may also include points that define the approximate approaches to each intersection. The term "approach" as used throughout this detailed description and in the claims refers to a predefined segment of a roadway leading to an entrance of an intersection. In one embodiment, traffic control information 350 may include first inner approach point 361 and first outer approach point 362 that define first approach 360, which is an approach along first roadway 301. First inner approach point 361 may be associated with the approximate location of first entrance 311. In embodiments where an intersection includes a stop-bar, first inner approach point 361 may be associated with the approximate location of the stop-bar. First outer approach point 362 may be located further away from intersection 300 than first inner approach point 361. First outer approach point 362 may help to define the approximate direction of first approach 360.

In a similar manner, traffic control information 350 may include additional points used to represent approaches to intersection 300 along second roadway 302, third roadway 303 and fourth roadway 304. For example, second inner approach point 371 and second outer approach point 372 may be used to define second approach 370. Likewise, third inner approach point 381 and third outer approach point 382 may be used to define third approach 380. Also, fourth inner approach point 391 and fourth outer approach point 392 may be used to define fourth approach 390. In each of these approaches, second inner approach point 371, third inner approach point 381 and fourth inner approach point 391 are associated with the approximate locations of stop-bars at second entrance 312, third entrance 313 and fourth entrance 314, respectively. Likewise, second outer approach point 372, third outer approach point 382 and fourth outer approach point 392 are used to define the approximate directions of second approach 370, third approach 380 and fourth approach 390, respectively. Using this configuration, traffic control information 350 can be used to represent the approximate locations of first stop-sign 321, second stop-sign 322, third stop-sign 323 and fourth stop-sign 324 as well as the direction of approach to each stop sign.

In different embodiments, approach points could be stored in various manners. In some cases, each approach point (including both outer and inner approach points) could be stored using an absolute coordinate such as a longitude and latitude coordinate. In other embodiments, however, each approach point could be stored as a relative coordinate with respect to a center point. For example, in some embodiments, first inner approach point 361 may be stored using a longitude offset and a latitude offset from center point 352. In particular, in the current embodiment, first inner approach point 361 may be a distance D1 from center point 352 in the longitudinal direction and a distance D2 from center point 352 in the latitudinal direction. Therefore, first inner approach point 361 may be stored as a pair of relative distances. Likewise, first outer approach point 362 may be a distance D3 from center point 352 in the latitudinal direction and a distance D1 from center point 352 in the longitudinal direction. Second inner approach point 362 may also be stored as a pair of relative distances. Furthermore, in some cases, each additional approach point associated with traffic control information 352 may be stored using relative distances to center point 352. It will be understood that relative distances could be stored as positive or negative values.

A traffic control database can include provisions for storing information related to the geometry of an approach to an intersection. In some cases, each approach can be defined using three approach points. In other cases, each approach can be defined using four or more approach points.

Figure 4:
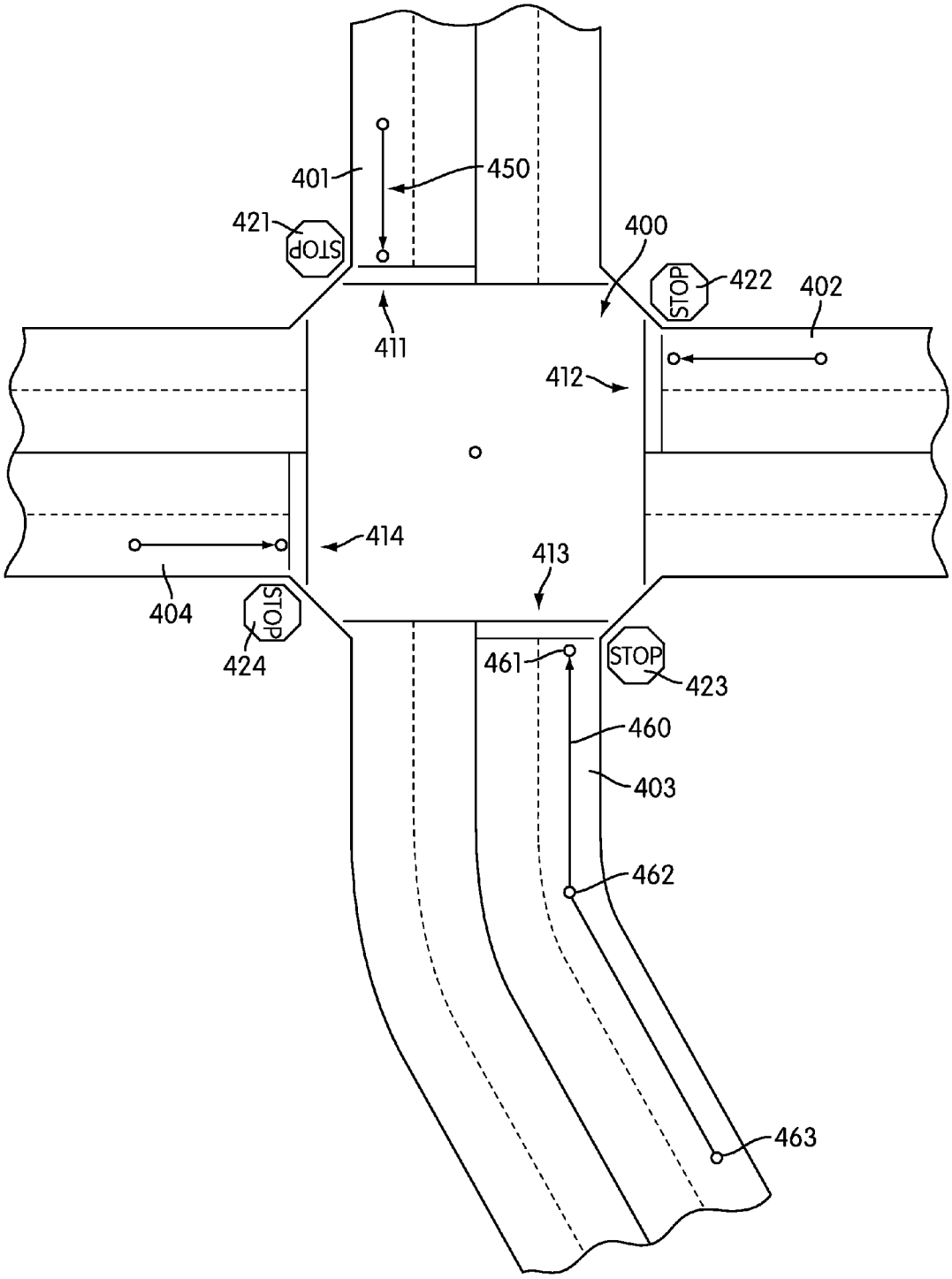
FIG. 4 is a schematic view of an embodiment of an intersection in which approaches to the intersection are defined by two or three approach points.

FIG. 4 illustrates another embodiment of a method of representing traffic control information associated with one or more traffic control signs at an intersection. Referring to FIG. 4, intersection 400 is associated with the intersection of first roadway 401, second roadway 402, third roadway 403 and fourth roadway 404. Intersection 400 also includes first entrance 411, second entrance 412, third entrance 413 and fourth entrance 414 associated with first roadway 401, second roadway 402, third roadway 403 and fourth roadway 404, respectively. In addition, intersection 400 is associated with four stop-signs including first stop sign 421, second stop sign 422, third stop sign 423 and fourth stop-sign 424 that control the flow of traffic through first entrance 411, second entrance 412, third entrance 413 and fourth entrance 414, respectively.

In the exemplary embodiment shown in FIG. 4, first roadway 401, second roadway 402 and fourth roadway 404 are all associated with approximately straight approaches. In particular, each approach for first roadway 401, second roadway 402 and fourth roadway 404 are straight approaches that are defined by two approach points. This configuration is similar to the embodiment shown in FIG. 3. In contrast, third roadway 403 is associated with a curved approach. In particular, traffic control information 450 includes approach 460 that is a curved approach associated with third roadway 403. Approach 460 is defined using inner approach point 461, first outer approach point 462 and second outer approach point 463. Inner approach point 461 is associated with the approximate location of a stop-bar at third entrance 413. First outer approach point 462 is used to define the approximate direction of approach 460. Additionally, second outer approach point 463 may be used to approximate the curvature of third roadway 403. Using this arrangement, a traffic control database can be configured to provide some geometric information about approaches associated with one or more stop-signs.

It will be understood that while the current embodiment uses three approach points to approximate a curved approach to an intersection, in other embodiments four or more approach points could be used. In general, any curved approach could be approximated by a finite number of approach points.

While the current embodiments illustrate intersections controlled by stop-signs, in other embodiments a traffic control database can provide information related to any other type of traffic control sign or device. For example, in another embodiment a traffic control database could include information related to yield signs. In still another embodiment, traffic control database could include information related to traffic signals.

A traffic control database can include provisions for storing traffic control information for a plurality of intersections in a manner that facilitates compact storage and efficient database distribution. In some embodiments, a traffic control database can include various tables for associating traffic control information with a plurality of intersections. In some cases, a traffic control database can include an area table, an intersection table and an approach table for organizing traffic control information.

Figure 5:
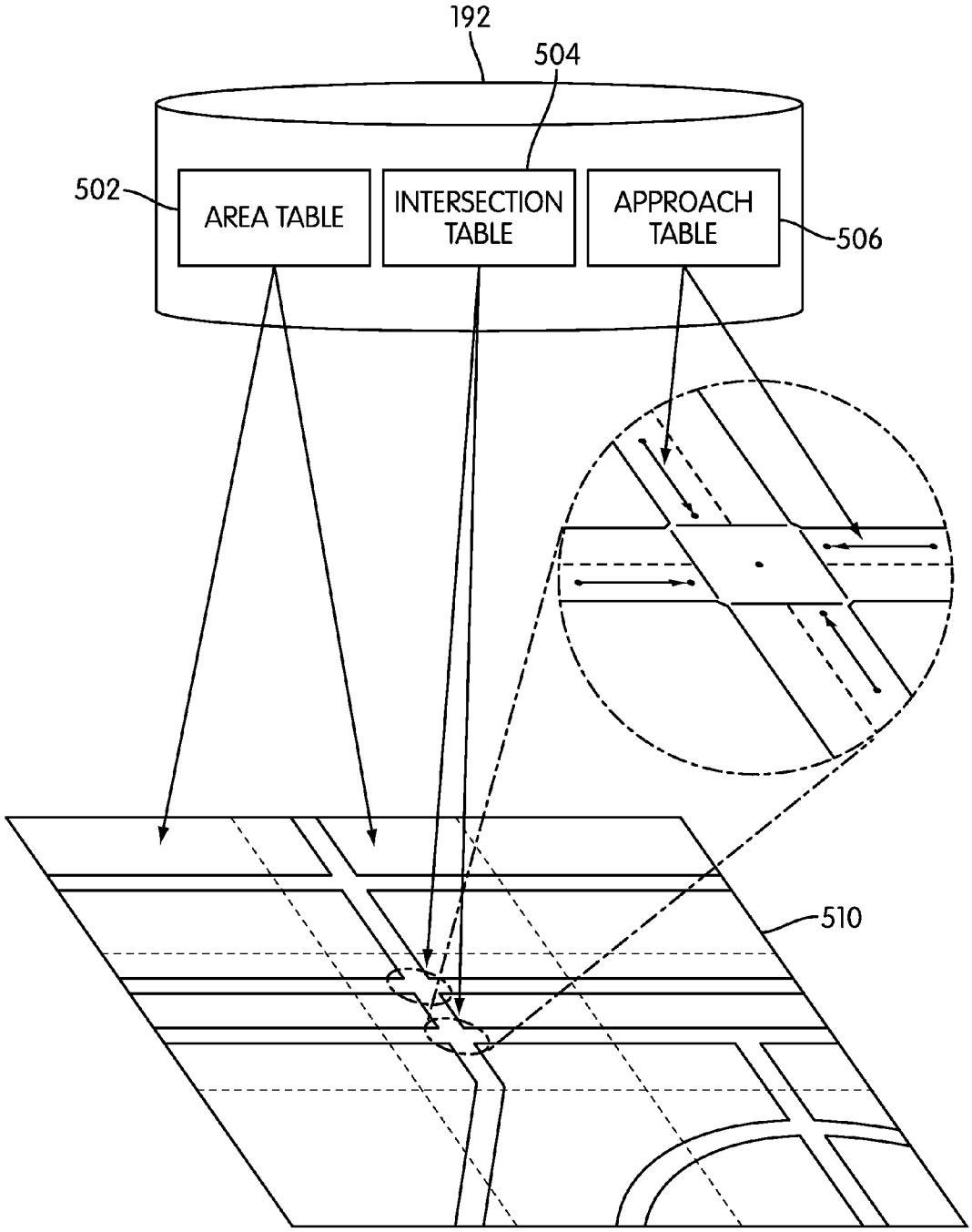
FIG. 5 is a schematic view of an embodiment of a traffic control database including multiple tables for storing data.

FIG. 5 illustrates an exemplary embodiment of an organizational structure for a traffic control database. Referring to FIG. 5, traffic control database 192 includes area table 502, intersection table 504 and approach table 506. Area table 502 stores information related to different geographic areas or regions. For example, in the current embodiment, map portion 510 is divided into nine different geographic areas. Each area may be associated with none, one or more different intersections. Intersection table 504 stores information related to different intersections within a particular area. In some cases, the center point for each intersection can be stored as an absolute coordinate. Each intersection can be associated with a plurality of approaches that are controlled by a traffic control sign such as a stop sign. Approach table 506 stores information related to different approaches associated with a particular intersection. Each approach can comprise two or more approach points. In some cases, the approach points may be stored as relative coordinates with respect to a center point of the relevant intersection.

Figure 6:
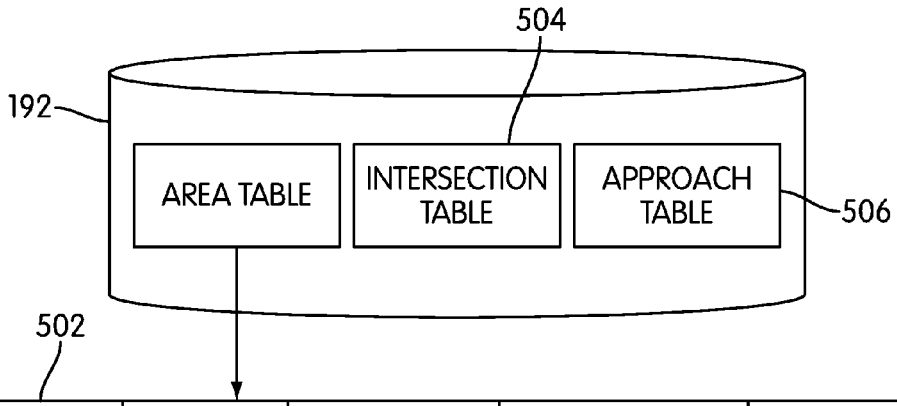
FIG. 6 is a schematic view of an embodiment of an area table for a traffic control database.
Figure 6:
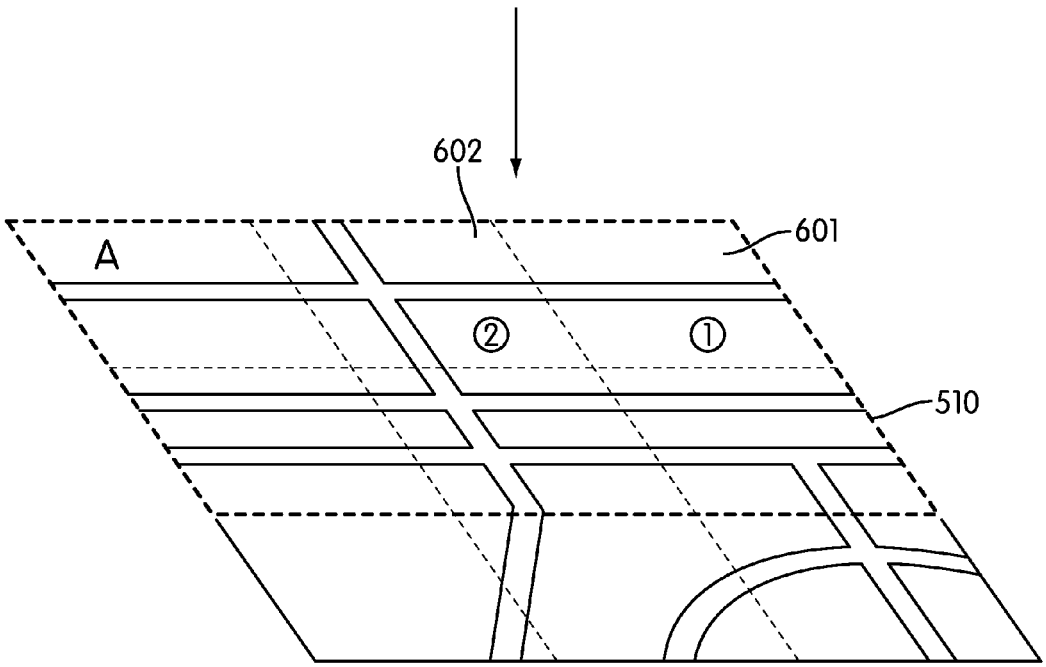
Figure 7:
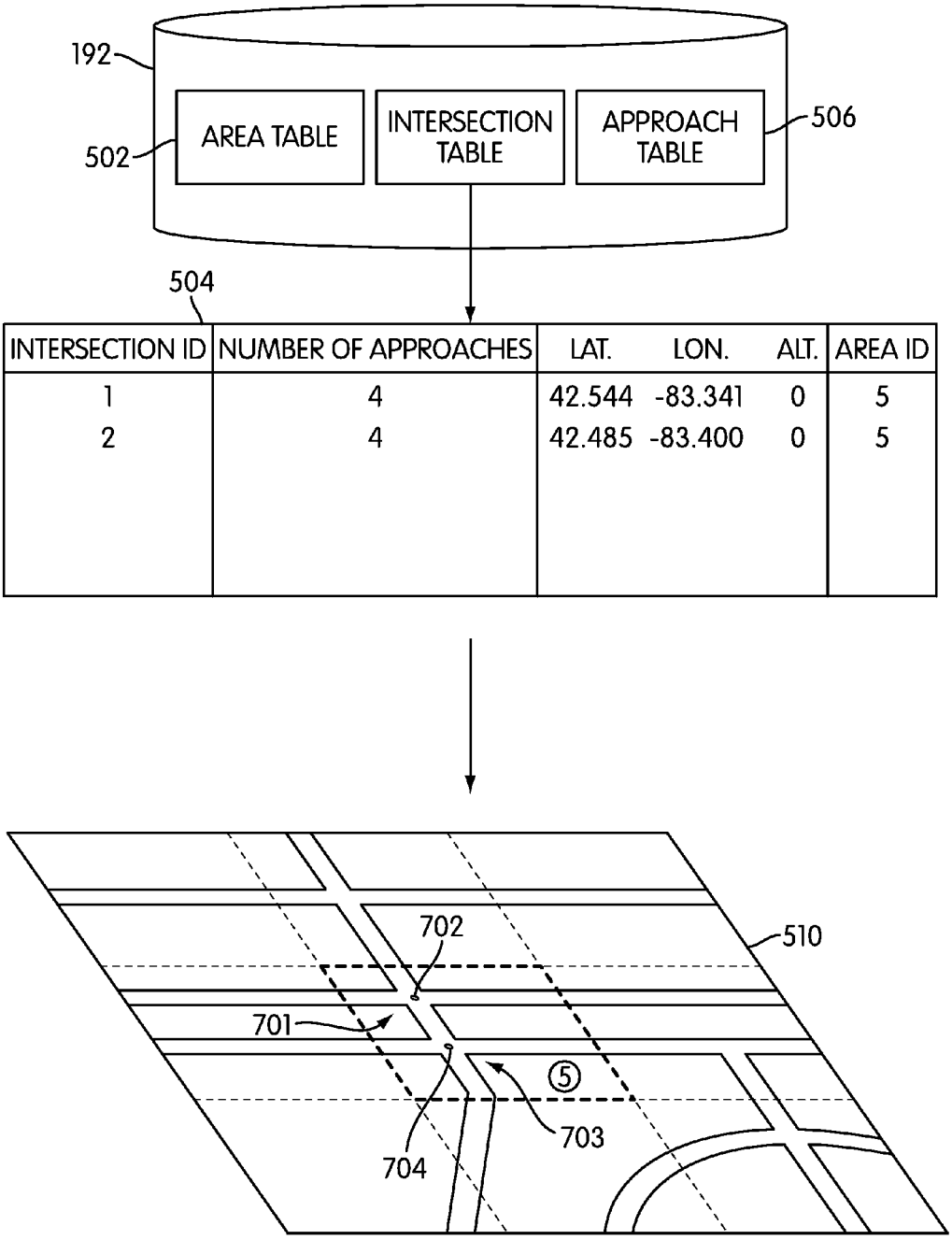
FIG. 7 is a schematic view of an embodiment of an intersection table for a traffic control database.
Figure 8:
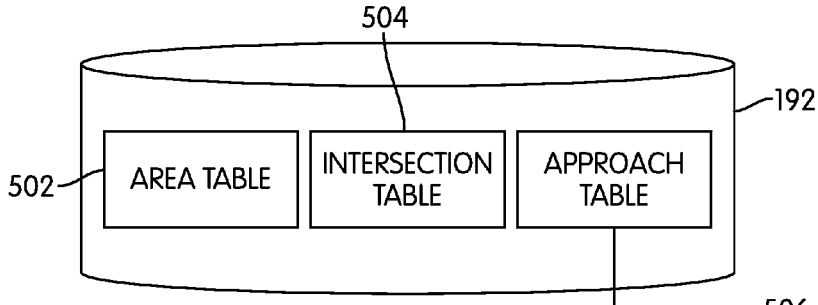
FIG. 8 is a schematic view of an embodiment of an approach table for a traffic control database.
Figure 8:
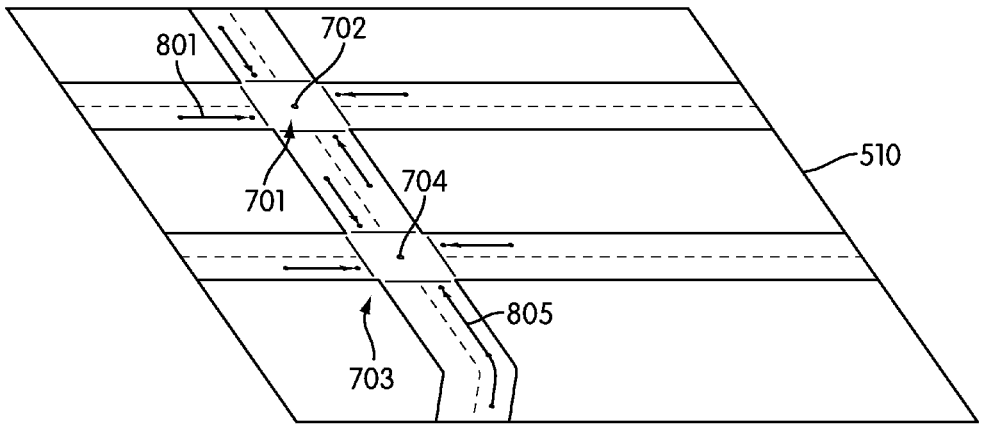

FIGS. 6 through 8 are intended to illustrate exemplary embodiments of various tables for a traffic control database. Referring to FIG. 6, area table 502 may be used to store intersection information in an area dependent manner. An area table can include identification numbers for various areas. For example, each row of area table 502 is associated with a particular geographic area. In this case, information about area 601 and area 602 is stored in the first and second rows, respectively, of area table 502. This information includes date and time information for determining when traffic control information in the area was last updated, geographic boundary information for each area, and the number of intersections within each area. For example, in the current embodiment, area 601 has no intersections while area 602 has one intersection. Furthermore, in some cases, area table 502 could include area parent information that indicates larger areas that contain each area in the table. For example, in one embodiment, area 601 and area 602 are associated with parent area A. Using this configuration for area table 502, traffic control information can be stored efficiently according to location.

Referring to FIG. 7, intersection table 504 may include information about each intersection in an area, including the number of approaches as well as the location of the center point of the intersection. Intersection table 504 includes the identifying number of each intersection, the number of approaches at each intersection, the latitude of the center point of the intersection, the longitude of the center point of the intersection and the identification number of the area for the intersection. For example, in the current embodiment, information about intersection 701 and intersection 703 are stored in the first and second row, respectively, of intersection table 504. Each intersection includes four approaches. Furthermore, the latitude, longitude and altitude coordinates of center point 702 and center point 704 of intersection 701 and intersection 703, respectively, are stored intersection table 504. In some cases, the latitude and longitude may be stored in degrees, while the altitude may be stored as meters relative to sea level. In other cases, however, the latitude, longitude and/or altitude could be stored using any units. Also, intersection 701 and intersection 703 are each associated with area 5.

Referring to FIG. 8, approach table 506 may include information about each approach. Approach table 506 includes an identifying number for each approach, the type of intersection control (right-of-way, stop-sign, etc.), and the latitude and longitude offsets from the center point for each approach point. In particular, approach table 506 includes the longitude offset and the latitude offset for the inner approach point, first outer approach point and second outer approach point for each approach. For example, approach 801 of intersection 701 includes an inner approach point and an outer approach point. The locations of the inner approach point and outer approach point are stored as relative coordinates with respect to center point 702 of intersection 701 in the first row of approach table 506. For example, approach 801 has an inner approach point located at −3.0 meters in the latitude direction and −7.0 meters in the longitude direction from center point 702. Likewise, approach 801 has an outer approach point located at −3.0 meters in the latitude direction and −57.0 meters in the longitude direction.

In embodiments where the center point includes an altitude coordinate, it may be assumed that the altitudes of each approach point is approximately equal to the altitudes of the associated center point. In other cases, however, a separate altitude coordinate could be stored for each approach point.

In some cases, zeros may be used as offset coordinates for second outer approach points when an approach only has two approach points. For example, in this embodiment, approach 801 is a straight approach and is associated with two approach points. The offsets for the second outer approach point of approach 801 are therefore set to 0. In contrast, approach 805 of second intersection 703 is a curved approach defined by three approach points. The offsets for all three approach points of approach 805 are given in the sixth row of approach table 506.

Generally, the longitude and latitude offsets for each approach point could be given in any units. In one embodiment, the offsets are given in meters. In other embodiments, however, the offsets could be given in degrees, miles, kilometers and/or any other unit.

It will be understood that the configuration for area table 502, intersection table 504 and approach table 506 is only intended to be exemplary and in other embodiments, each table could be arranged in any manner. Moreover, in other embodiments, traffic control database 192 could comprise less than three tables. In still other embodiments, traffic control database 192 could comprise more than three tables.

Traffic control databases can be distributed in various manners. In some cases, traffic control databases can be preinstalled in a vehicle at the time of manufacturing. In the case of the database being loaded into the vehicle at the time of manufacturing, the database may be prepared as a memory image file and programmed to the processor memory as a part of the regular production process. In other cases, traffic control databases can be installed by a dealer. In still other embodiments, traffic control databases can be updated after a vehicle has been purchased using a remote network such as a vehicle communications network.

Figure 9:
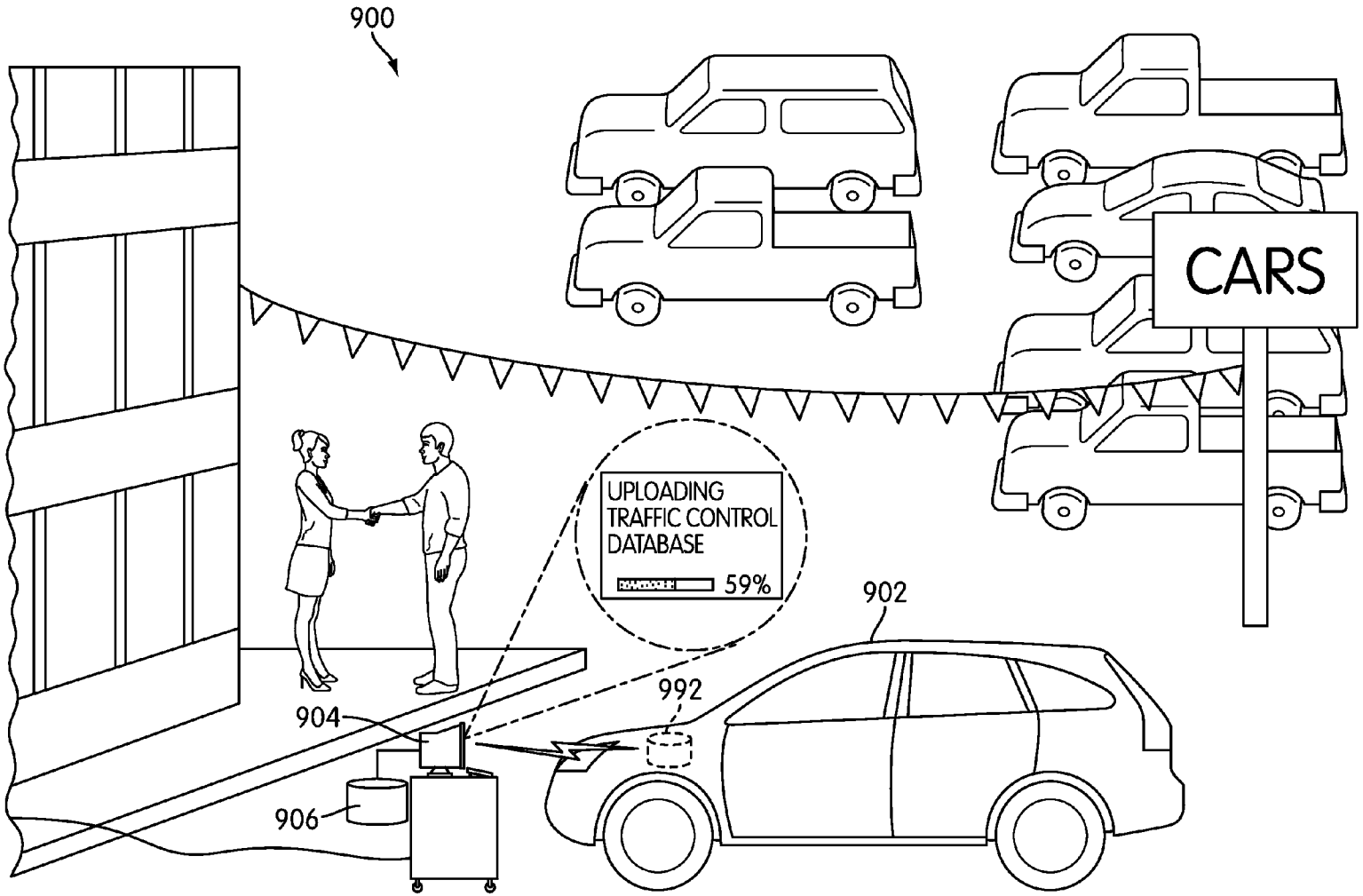
FIG. 9 is a view of an embodiment of a method of distributing a traffic control database to a vehicle.

FIG. 9 illustrates an embodiment of a method of distributing traffic control information to a preinstalled database within a motor vehicle. Referring to FIG. 9, vehicle dealership 900 may be equipped to transmit traffic control information to traffic control database 992 of motor vehicle 902. In this embodiment, dealership 900 is configured with computer system 904. The term "computer system" refers to the computing resources of a single computer, a portion of the computing resources of a single computer, and/or two or more computers in communication with one another. In addition, computer system 904 may be further associated with database 906. Database 906 can be any kind of storage device including but not limited to: magnetic, optical, magneto-optical, and/or memory, including volatile and non-volatile memory. In some cases, database 906 may be integral with computer system 904. In other cases, database 906 may be separate from computer system 904.

Database 906 may be configured to store traffic control information. In particular, database 906 may include information related to the locations of a center point as well as multiple approach points for each intersection in one or more predetermined geographic areas.

Computer system 904 may communicate with traffic control database 992 of motor vehicle 902. In some cases, computer system 904 may communicate with some type of ECU connected to database 992. In other cases, computer system 904 may communicate directly with database 992. Furthermore, computer system 904 may communicate with database 992 using any type of wired or wireless network. In embodiments where a wireless network is used, the network can be any type of wireless network. Examples of wireless networks include, but are not limited to: any cellular telephone networks, personal area networks, local area networks, wide area networks, client-server networks, peer-to-peer networks, as well as other types of networks. Additionally, the network may support wired transmissions, wireless transmissions, or both wired and wireless transmissions. In some embodiments, the network may be a packet-switched communications system. In some embodiments, the network may be a vehicle communication network, such as a DSRC network which has been discussed in detail above.

In this embodiment, traffic control information can be uploaded from database 906 to traffic control database 992. In some cases, only portions of database 906 corresponding to geographically relevant areas may be uploaded to traffic control database 992.

Although the current embodiment discusses a method of transferring traffic control information to a traffic control database at a dealership, in other embodiments traffic control information could be transferred to a traffic control database at any other location including a manufacturing facility such as a factory, a service facility as well as any other location. As an example, in one embodiment a user could access traffic control information at home through the internet and transfer the information to a traffic control database on a vehicle using any type of wired or wireless network.

A method for distributing traffic control databases can include provisions for reducing the amount of information required to be stored and updated. For example, in some cases, a database may be configured to store traffic control information relevant to a particular geographic area in which a motor vehicle is traveling. Moreover, as a vehicle travels from one area to another, a system can include provisions for retrieving updated traffic control information relevant to the newly traveled areas.

Figure 10:
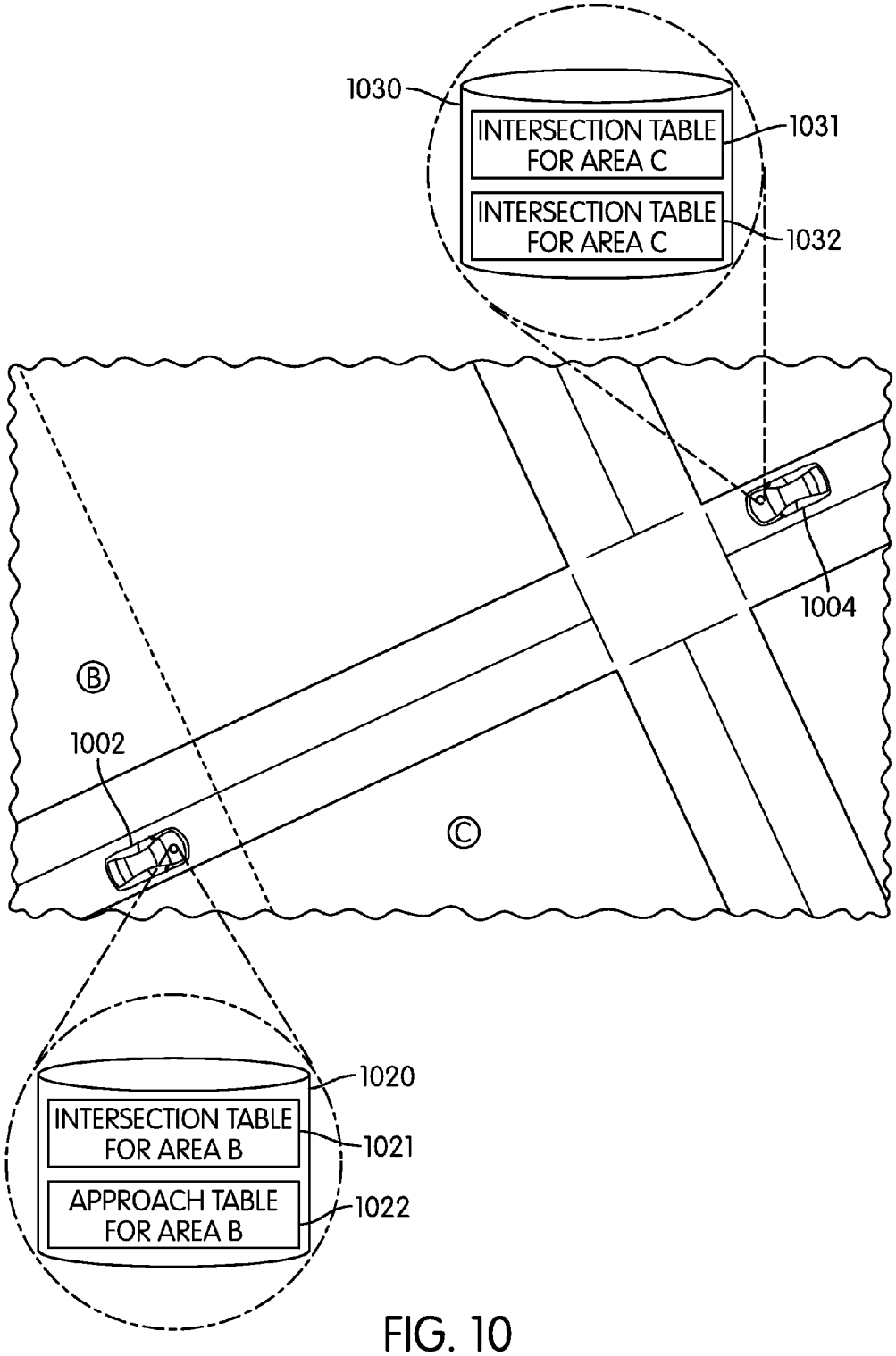
FIG. 10 is a schematic view of an embodiment of a method of distributing a traffic control database between vehicles.
Figure 11:
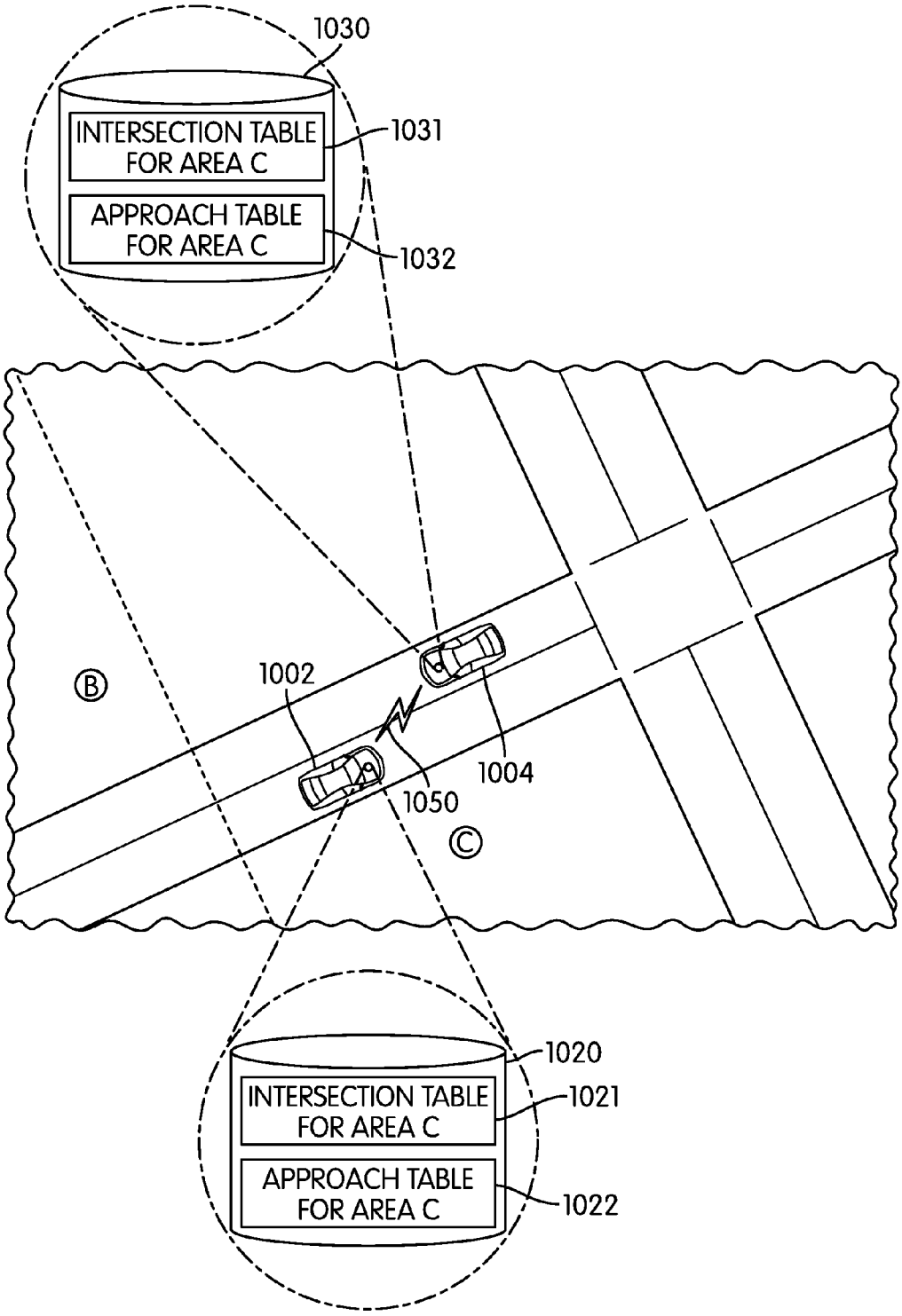
FIG. 11 is a schematic view of an embodiment of a method of distributing a traffic control database between vehicles.

FIGS. 10 and 11 illustrate another method for distributing traffic control information. Referring to FIGS. 10 and 11, motor vehicle 1002 is initially traveling in area B, while motor vehicle 1004 is initially traveling in area C. Motor vehicle 1002 includes traffic control database 1020 and motor vehicle 1004 includes traffic control database 1030. In the embodiment, traffic control database 1020 includes intersection table 1021 and approach table 1022 that are configured with intersection and approach information relevant to area B. In contrast, traffic control database 1030 includes intersection table 1031 and approach table 1032 that are configured with intersection and approach information relevant to area C.

Referring to FIG. 11, as motor vehicle 1002 enters area C, motor vehicle 1002 may query motor vehicle 1004 to determine if motor vehicle 1004 has an updated traffic control database with intersection tables and approach tables for area C. In some cases, this communication can be performed using vehicle communication network 1050. Since motor vehicle 1004 has intersection and approach tables for area C, motor vehicle 1002 may download updated traffic control information from motor vehicle 1004 using vehicle communication network 1050. This arrangement allows traffic control information to be updated as vehicles travel into new areas and helps reduce storage requirements since only traffic control information relevant to the currently traveled area is stored in a database.

Figure 12:
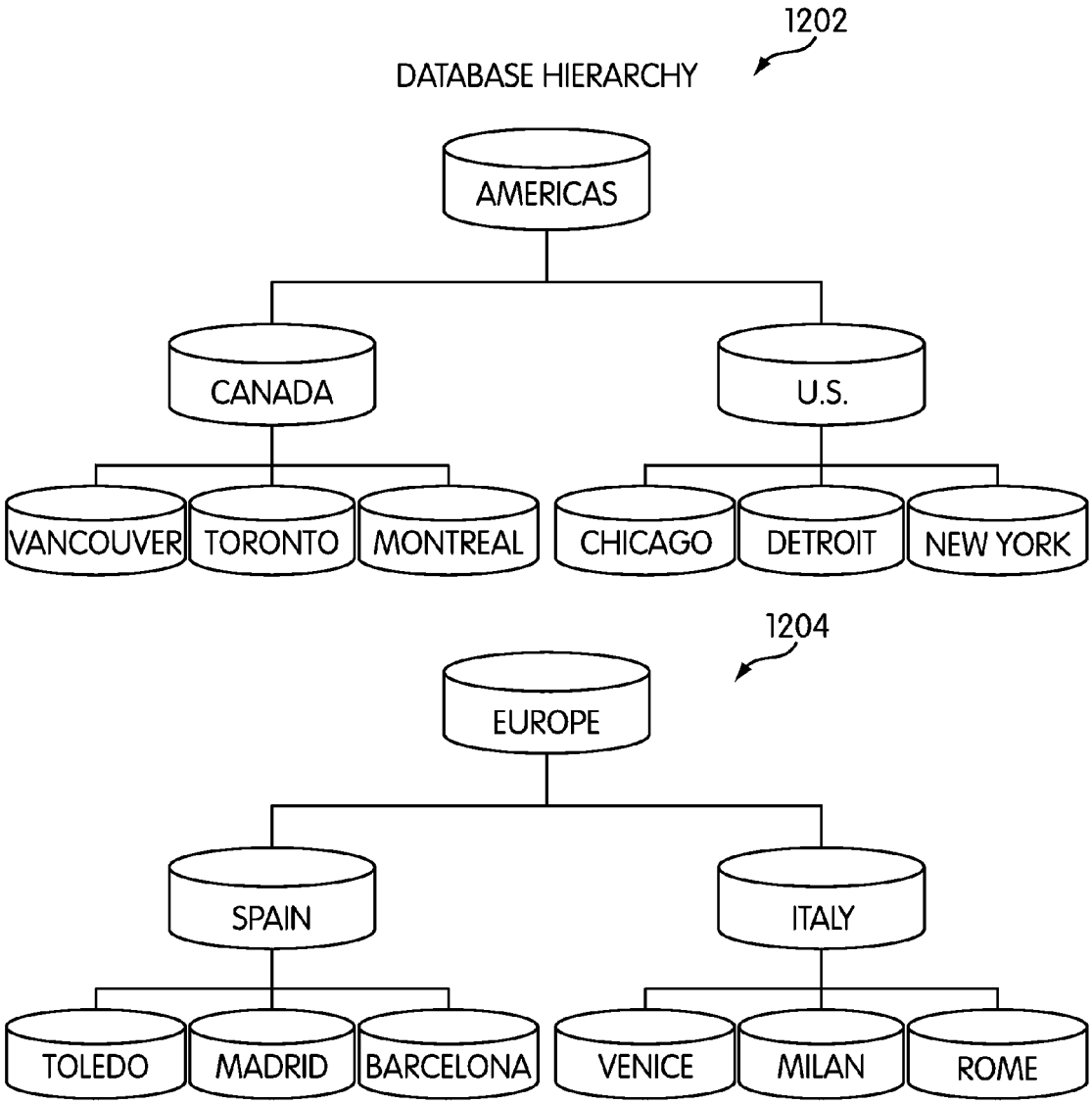
FIG. 12 is a schematic view of an embodiment of a traffic control database hierarchy.

As shown in FIG. 12, the areas may be configured in a hierarchy from largest area (continent, e.g.) to smallest area (city, e.g.). For example, in the current embodiment, the geographic areas may be organized into a first region 1202 and a second region 1204. First region 1202 may be associated with the Americas. This region may be further divided into various countries including (for example, Canada and the U.S.). Each country may be further subdivided into various cities. Second region 1204 may be associated with Europe and can be further subdivided into individual countries such as Spain and Italy. These countries can be further subdivided into individual cities.

This database hierarchy design is only intended to be exemplary. The database design can be further detailed if needed. Using this arrangement, traffic control information can be updated at various levels according to the needs of the user. For example, a user traveling between various cities in Italy may only require updated traffic control information at the city level. In contrast, as a user travels from one country to another, the traffic control information must be updated to include each city within the new country. This hierarchical design helps to improve the efficiency of the updating process and can help reduce communication costs and information transfer times.

Although the current embodiment illustrates a method of updating traffic control information as a vehicle travels between different geographic areas, it will be understood that in other embodiments, traffic control information can be updated based on date and time information. In some cases, the date of the last update of intersection information for a region is stored along with intersection information for the region. The date is used to determine whether the region is out of date compared to information in other vehicles or dealer databases.

Figure 13:
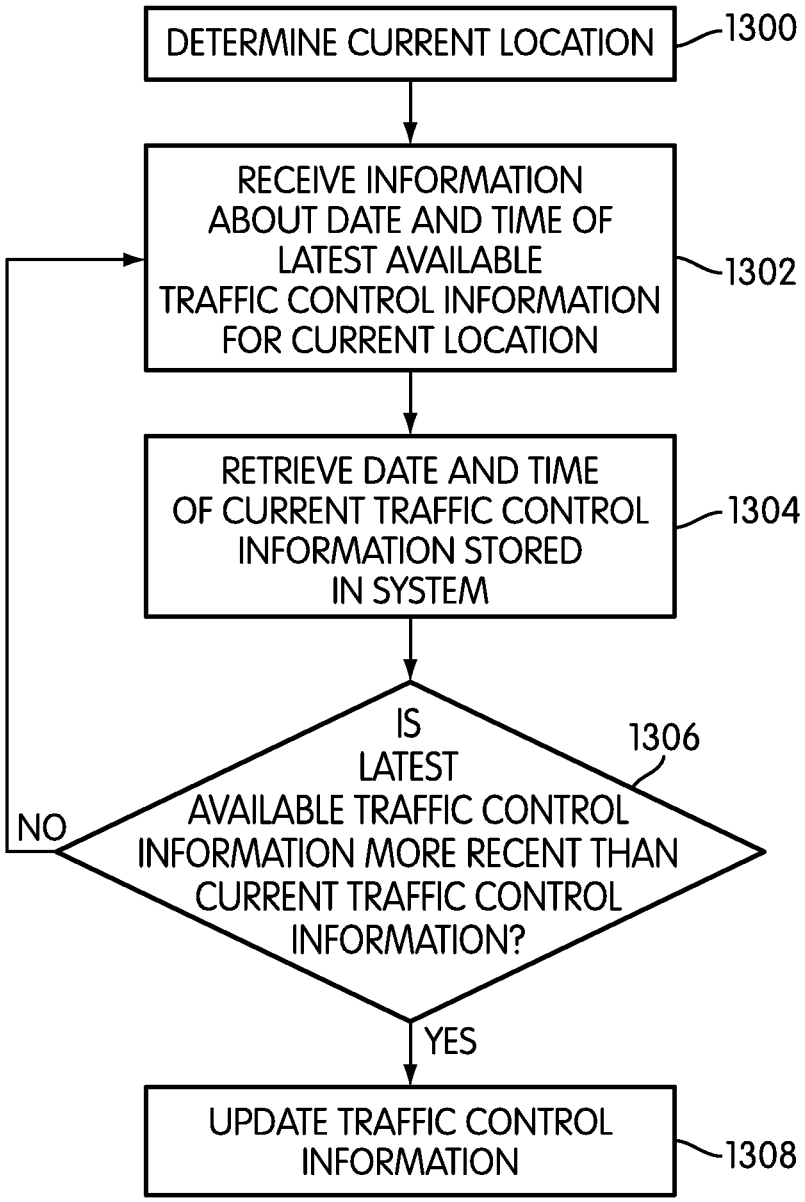
FIG. 13 is an embodiment of a process for updating a traffic control database.

FIG. 13 is an embodiment of a process for updating intersection information. In this embodiment, the following steps may be performed by ECU 120; however in some embodiments these steps may be performed by additional systems or devices associated with ECU 120 and/or motor vehicle 102. In addition, it will be understood that in other embodiments one or more of the following steps may be optional.

During step 1300, a system may receive a location. In some cases, the location may be the current location of the vehicle. In other cases, however, the location could be any other location. In some embodiments, the current location may be received from a GPS receiver. During step 1302, a system may receive information about the date and/or time of the latest available traffic control information. This information can be received through any type of communication including both wired or wireless communication. In some cases, this information can be received through a DSRC network.

Next, during step 1304, a system may retrieve the date and/or time of current traffic control information that is being stored in the system. In some cases, the information could be stored in an onboard database of some kind. Following this, during step 1306, the system may determine if the latest available traffic control information is more recent than the current traffic control information. This can be done by comparing the date and/or time of the latest available traffic control information with the date and/or time of the current traffic control information. If the latest available traffic control information is more recent, the system may proceed to step 1308 where the traffic control information can be updated. In some cases, updated traffic control information can be received from a nearby vehicle that is in communication with motor vehicle 102 using a vehicle communication network. If the latest available traffic control information is not more recent than the current traffic control information, the system may return to step 1302.

It will be understood that in other embodiments, a motor vehicle can update traffic control information for any areas, not just the areas corresponding to the current location of the motor vehicle. For example, in some cases, a motor vehicle may query a passing vehicle for the latest traffic control information for any areas stored in the database of the passing vehicle and update traffic control information for any out of date areas.

A traffic control database can be used with a warning system that helps to alert drivers about the presence of traffic control signs or devices. In some cases, a traffic control database may be used to warn a driver about a potential stop-sign violation.

Figure 14:
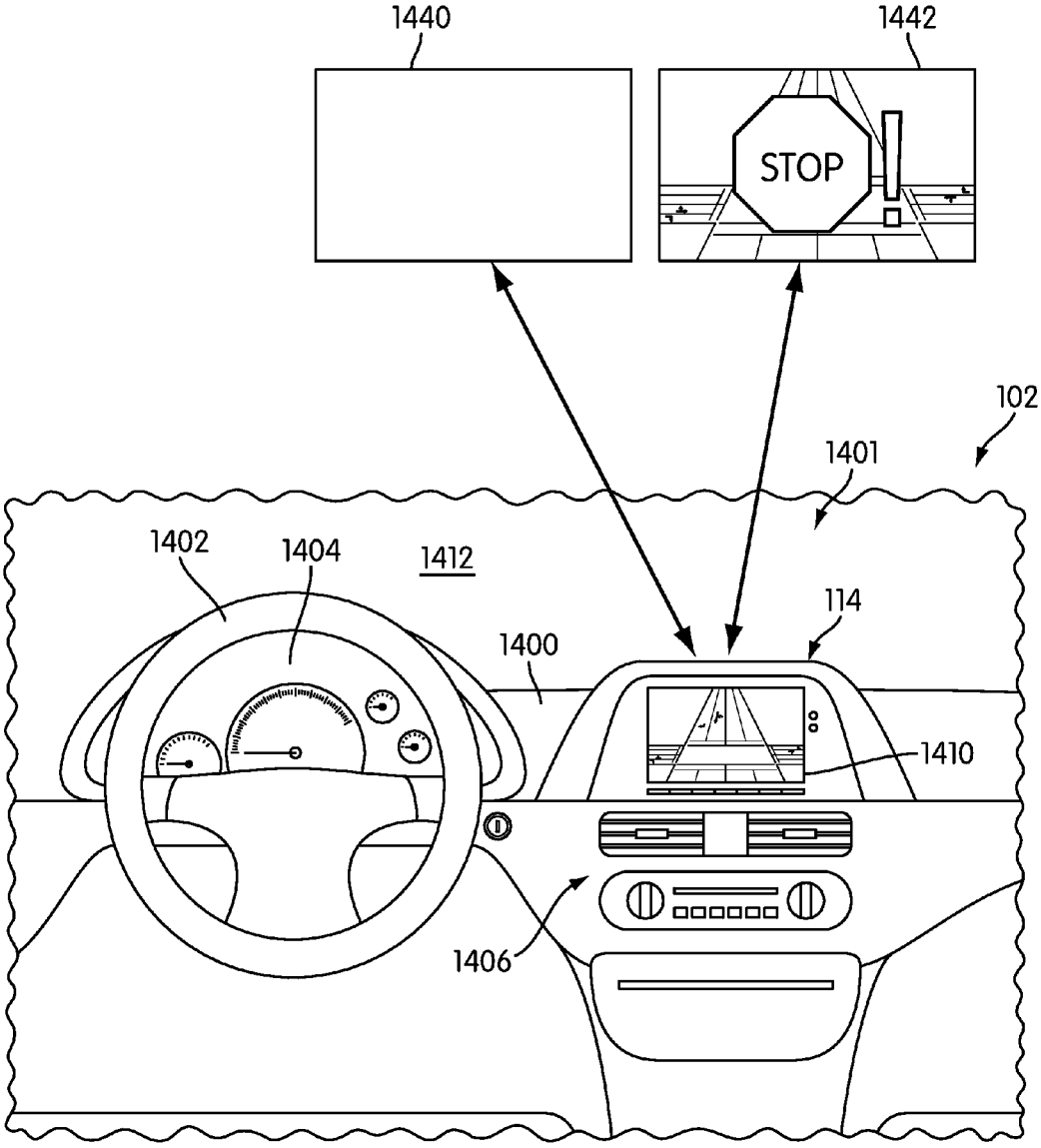
FIG. 14 is a schematic view of an embodiment of a warning system for a motor vehicle.

FIG. 14 illustrates an embodiment of dashboard 1400 for motor vehicle 102. Dashboard 1400 may include steering wheel 1402 and instrument panel 1404. In some embodiments, dashboard 1400 can further include center portion 1406. In some cases, center portion 1406 can include one or more devices associated with an interior of a motor vehicle. Examples include, but are not limited to: audio devices, video devices, navigation devices, as well as any other types of devices. In addition, center portion 1406 can be associated with controls for one or more systems of motor vehicle 102 including, but not limited to: climate control systems and other types of systems.

Motor vehicle 102 may include a warning system that provides information and/or alerts to a driver. In one embodiment, warning system 1401 can comprise one or more components including a processing unit as well as an interface for displaying and/or receiving information. In some cases, warning system 1401 may be associated with ECU 120, which is seen in FIG. 1. In addition, warning system 1401 can also be associated with driver vehicle interface 114 of motor vehicle 102. Moreover, in some cases, warning system 1401 can be associated with any other components of motor vehicle 102, including components not shown in the current embodiment.

A motor vehicle can include provisions for displaying information from a warning system. In some embodiments, a motor vehicle can include a display device of some kind. In some cases, a motor vehicle can include a video screen for displaying information from a warning system. Examples of display devices include, but are not limited to: LCDs, CRTs, ELDs, LEDs, OLEDs, HUDs, as well as other types of displays. In other cases, a display device could be a projection type display device that is configured to project an image onto one or more surfaces of motor vehicle 102. It will be understood that a display device may not be limited to a video screen or projection type display device.

In one embodiment, motor vehicle 102 can include display device 1410. In some cases, display device 1410 may be associated with driver vehicle interface 114 of motor vehicle 102. In particular, display device 1410 may be configured to present visual information received from motor vehicle 102. In an exemplary embodiment, display device 1410 may be an LCD screen.

In some embodiments, display device 1410 can be disposed within center portion 1406. However, it will be understood that in other embodiments, display device 1410 can be located in any portion of motor vehicle 102 as long as display device 1410 can be viewed by a driver. For example, in another embodiment, display device 1410 may be a projection type device that displays an image onto front window 1412. In addition, while display device 1410 can be configured to present visual information received from motor vehicle 102, display device 1410 may be shared with other devices or systems within motor vehicle 102. For example, display device 1410 could also be used as a screen for a navigation system.

It will be understood that in some embodiments, a driver vehicle interface can include additional provisions beyond a display screen. For example, in another embodiment, a driver vehicle interface can also be associated with one or more input devices that allow a driver to control various aspects of a warning system. In some cases, a driver vehicle interface can include an on/off button for turning a warning system on and off. In still another embodiment, a driver vehicle interface can be associated with speakers for generating auditory information. In still other embodiments, a driver vehicle interface can be associated with haptic means, such as a pulsing brake pedal or a vibrating seat.

A display device for a warning system can be configured to display one or more images associated with various types of alerts of the warning system. For purposes of clarity, the following detailed description discusses a warning system using a warning alert. Although a single type of alert is used in the current embodiment, in other embodiments other types of alerts could also be used.

In the exemplary embodiment, motor vehicle 102 includes warning alert image 1442 that is associated with a warning alert. Warning alert image 1442 may comprise one or more symbols or icons. In this embodiment, warning alert image 1442 depicts an intersection with a stop-sign. By displaying warning alert image 1442, a driver is alerted that the entrance to the upcoming intersection is controlled by a stop-sign. This information may help a driver to be more aware of a stop-sign as motor vehicle 102 approaches the upcoming intersection. Although a single image is shown for the warning alter image in the current embodiment, other embodiments can include more than one image for each type of alert. Moreover, any combination of icons, images, words as well as colors can be used with a warning alert image.

In addition, a display device may be configured to display no image when no alert has been issued by motor vehicle 102. In this embodiment, display device 1410 displays default screen 1440 when no alert is issued. In the exemplary embodiment, default screen 1440 is associated with a blank screen of display device 1410. However, in embodiments where display device 1410 is used for displaying information from other systems, default screen 1440 may not be a blank screen. For example, in embodiments where display device 1410 is shared between a navigational system and motor vehicle 102, display device 1410 may continue to display images received from the navigation system until an alert is issued. Likewise, once an alert has expired, display device 1410 may return to displaying images from a navigation system.

It should be understood that a warning system can be used for various different purposes. For example, in some cases a warning system can be used to alert a driver about potential stop-sign violations as well as for alerting a driver about potential collision threats posed by nearby vehicles. In still other embodiments, a warning system can be used for alerting a driver to various other kinds of safety issues.

Figure 15:
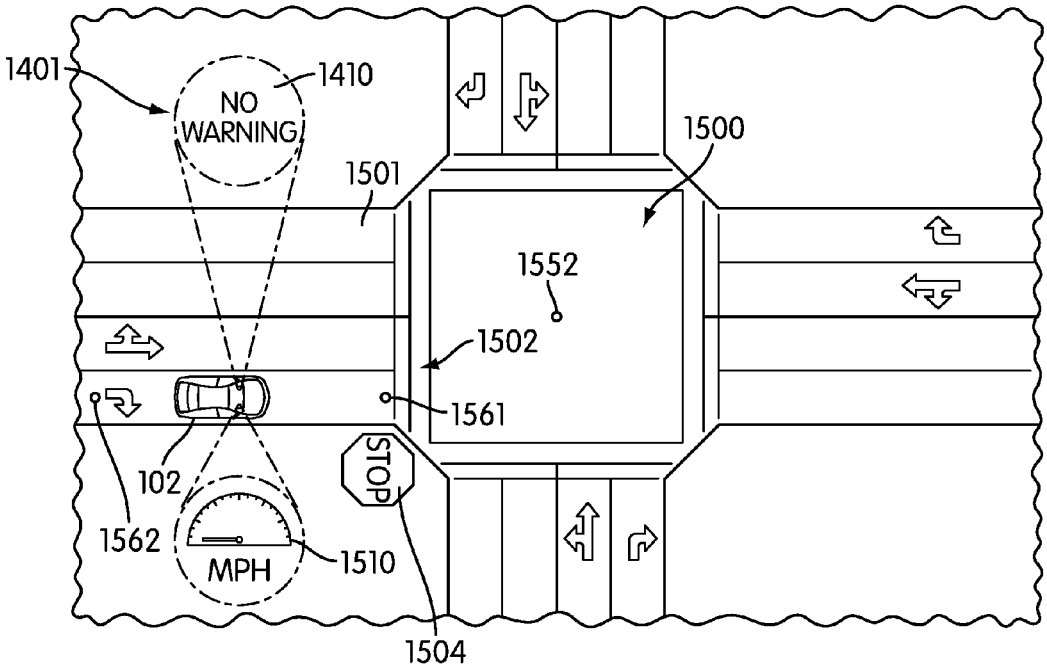
FIG. 15 is a schematic view of an embodiment of the operation of a warning system.
Figure 16:
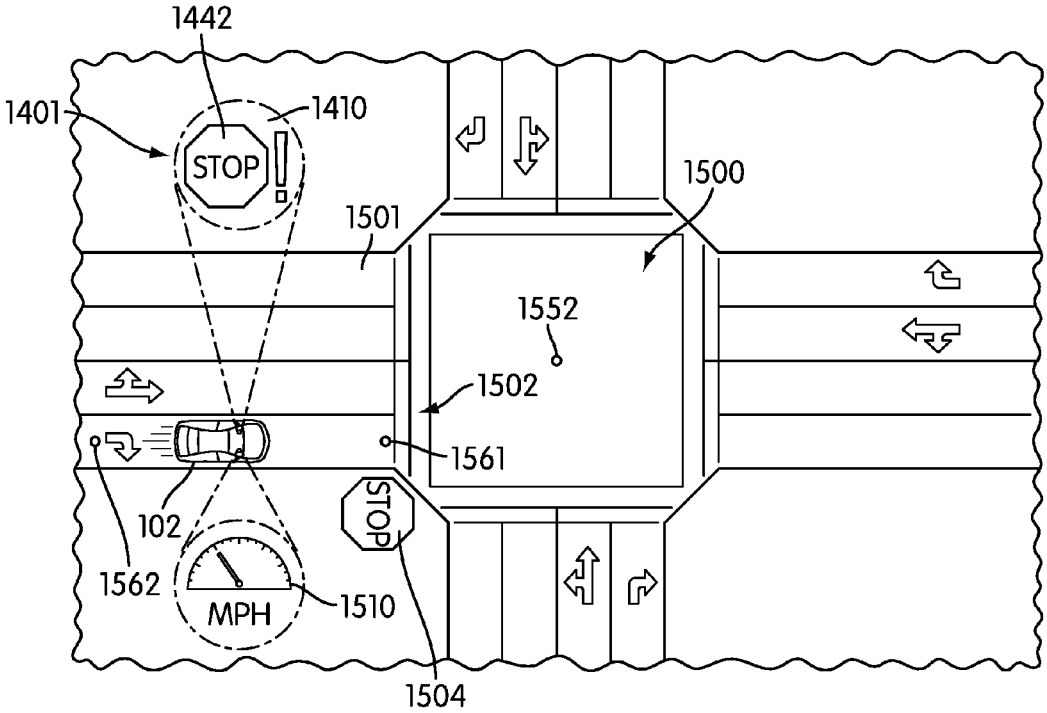
FIG. 16 is a schematic view of an embodiment of the operation of a warning system.

FIGS. 15 and 16 illustrate an embodiment of the operation of warning system 1401 associated with motor vehicle 102.

Referring to FIG. 15, warning system 1401 may retrieve information from a traffic control database to determine the relative locations of various approach points as motor vehicle 102 approaches an intersection. For example, in one embodiment, warning system 1401 may determine that motor vehicle 102 is approaching intersection 1500 by comparing the current location of motor vehicle 102 with the location of center point 1552. Center point 1552 is stored in a traffic control database. Warning system 1401 can also check for traffic control signs by retrieving any approach information from the traffic control database. Since stop-sign 1504 is present at entrance 1502 to intersection 1500, the warning system is able to retrieve multiple approach points. Warning system 1401 may retrieve the locations of inner approach point 1561 and outer approach point 1562, which correspond to an approach along first roadway 1501. Inner approach point 1561 is generally associated with the location of entrance 1502 to intersection 1500. Outer approach point 1562 helps to define the direction of the approach.

As motor vehicle 102 passes outer approach point 1562, warning system 1401 checks to see if motor vehicle 102 is operating in a manner that suggests motor vehicle 102 will stop at entrance 1502, which is associated with the position of inner approach point 1561. In some embodiments, warning system 1401 can check the speed of motor vehicle 102 and determine if motor vehicle 102 has sufficient time to stop at entrance 1502. In the situation shown in FIG. 15, motor vehicle 102 is traveling at a relatively slow speed as seen by speedometer 1510 and therefore warning system 1401 determines that there is sufficient time for motor vehicle 102 to stop at entrance 1502. In this case, no warning is displayed on display device 1410.

Referring now to FIG. 16, in this situation, motor vehicle 102 is traveling at a relatively high speed after passing outer approach point 1562. In this case, warning system 1401 may determine that motor vehicle 102 does not have sufficient time to stop safely at entrance 1502. Therefore, in this situation, warning system 1401 issues a warning alert. In particular, warning alert image 1442 is displayed on display device 1410. This helps alert the driver of motor vehicle 102 to the presence of stop-sign 1504 so that motor vehicle 102 can be stopped at entrance 1502 before proceeding through intersection 1500.

Figure 17:
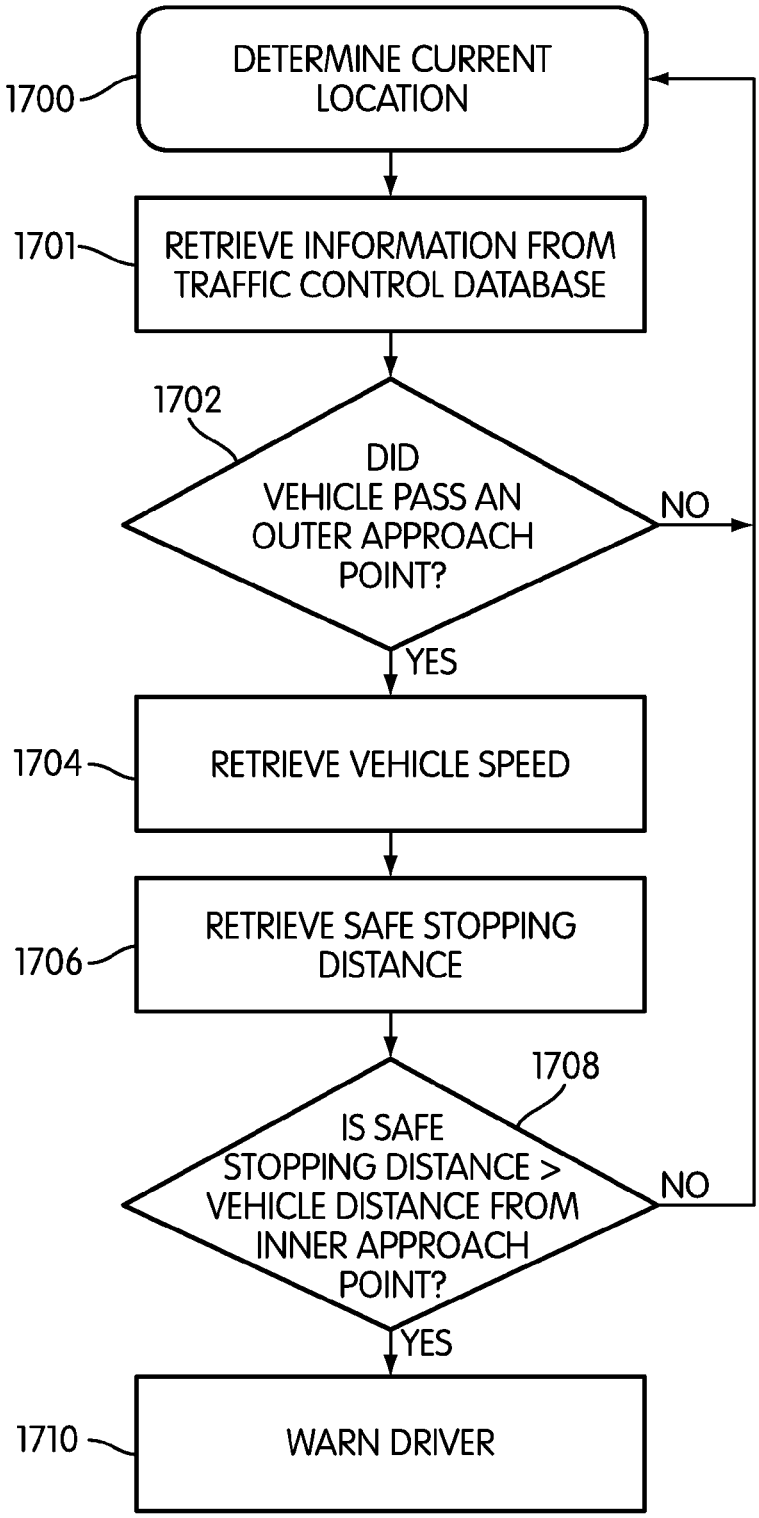
FIG. 17 is an embodiment of a process of operating a warning system using a traffic control database.

FIG. 17 illustrates an embodiment of the operation of a warning system in conjunction with a traffic control database. In this embodiment, the following steps may be performed by a warning system. In some cases, the steps may be performed by ECU 120; however in some embodiments these steps may be performed by additional systems or devices associated with ECU 120 and/or motor vehicle 102. In addition, it will be understood that in other embodiments one or more of the following steps may be optional.

Warning system 1401 may constantly monitor the location of vehicle 102, usually via GPS receiver 110 (see FIG. 1), during step 1700. During step 1701, warning system 1401 may retrieve information from a traffic control database. In one embodiment, warning system 1401 may retrieve information from traffic control database 192 (see FIG. 1). This information can include approach information for the current intersection including the locations of each approach point.

At step 1702, warning system 1401 compares the current location of vehicle 102 with the locations of intersection approach points. In particular, warning system 1401 may compare the current location of vehicle 102 with the locations of outer approach points. When warning system 1401 determines that vehicle 102 has passed an outer approach point, warning system 1401 may proceed to step 1704. Otherwise, warning system 1401 may proceed back to step 1700.

During step 1704, warning system 1401 may determine the current vehicle speed. In some cases, this can be done using vehicle speed sensor 197 (see FIG. 1). Next, during step 1706, warning system 1401 may retrieve a safe stopping distance as a function of one or more parameters. In some cases, warning system 1401 may retrieve a safe stopping distance as a function of vehicle speed. In addition, in some cases, warning system 1401 may retrieve a safe stopping distance as a function of the estimated road surface friction coefficient. In still other cases, a safe stopping distance can be retrieved as a function of any other parameters or combination of parameters.

Warning system 1401, at step 1708, may compare the retrieved safe stopping distance to the distance of vehicle 102 from the inner approach point associated with the current approach. If the safe stopping distance for vehicle 102 is greater than the distance of vehicle 102 from the inner approach point, motor vehicle 102 issues a warning to the driver. Otherwise, warning system 1401 returns to step 1700.

The determination of the point at which vehicle 102 may no longer be able to make a safe stop may be done by matching the current speed of vehicle 102 to safe stopping distances in a table. The table may have adjustments for factors such as road conditions and materials if warning system 1401 receives such information from sensors of vehicle 102, other vehicles, or infrastructure transceivers.

It will be understood that a database system for storing intersection information may not be limited to use with a particular kind of vehicle system. In particular, while the current embodiment utilizes a traffic control database for purposes of operating a warning system, in other embodiments a traffic control database could be used with any other systems that may require detailed traffic control information.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

I claim:

1. A motor vehicle, comprising:

a traffic control database configured to store traffic control information;

the traffic control information including information related to an approach to an intersection;

the approach being stored as a first approach point and a second approach point, wherein the first approach point is defined by an entrance to the intersection;

wherein the traffic control information includes a center point for the intersection;

wherein the second approach point is located further away from the center point of the intersection than the first approach point;

wherein the locations of the first approach point and the second approach point are defined by offsets from the center point; and wherein a direction of the approach is defined by the second approach point.

2. The motor vehicle according to claim 1, wherein the approach includes a third approach point that defines the curvature of the approach.

3. The motor vehicle according to claim 1, wherein the traffic control information is uploaded from at least one of a database at a dealership, a database at a service center, a database at a manufacturing facility and a database accessible through the internet.

4. The motor vehicle according to claim 1, wherein the motor vehicle comprises a vehicle communication network and the traffic control information can be updated from another motor vehicle using the vehicle communication network.

5. The motor vehicle according to claim 1, wherein the motor vehicle includes a warning system and wherein the warning system uses the traffic control database to provide warnings to a driver of potential traffic sign violations.

6. The motor vehicle according to claim 1, wherein the traffic control information includes an intersection identifier, the number of approaches in the intersection, and an identifier of a region that includes the intersection.

7. A method for updating traffic control information in a traffic control database for a motor vehicle comprising the steps of:

retrieving a location associated with a latest available traffic control information for the location, wherein said latest available traffic control information is characterized by a date, and wherein said traffic control information comprises information regarding stop signs and traffic lights;

receiving information concerning the date of the latest available traffic control information for the location;

comparing the date of the latest available traffic control information with the date of current traffic control information stored in the traffic control database;

receiving traffic control information if the latest available traffic control information is more recent than the current traffic control information stored in the traffic control database; and updating the current traffic control information;

wherein said current traffic control information comprises intersection tables and approach tables.

8. The method of claim 7, wherein the date and time of the latest available traffic control information are received.

9. The method of claim 8, wherein the date and time of the current traffic control information are compared with the date and time of the latest available traffic control information.

10. The method of claim 7, wherein the traffic control information is retrieved using a vehicle communication network.

11. The method according to claim 7, wherein the traffic control information is associated with a predetermined area.

12. The method according to claim 11, wherein the method includes a step of querying other vehicles for updates of traffic control information when traveling from a first area to a second area that is different from the first area.

13. A motor vehicle, comprising:

a warning system including a warning interface;

a GPS receiver;

a traffic control database configured to store traffic control information;

the traffic control information including information related to an approach to an intersection;

the approach being stored as a first approach point and a second approach point, the first approach point being associated with an entrance to the intersection and wherein a direction of the approach is defined by the second approach point;

wherein the traffic control information includes a center point associated with a center of the intersection;

wherein the locations of the first approach point and the second approach point are defined relative to the location of the center point; and wherein the warning system determines whether to issue a warning through the warning interface according to the position of the motor vehicle with respect to the first approach point and the second approach point, and stopping distance information, wherein the stopping distance information is obtained by matching a current speed of the vehicle to stopping distances in a table that includes adjustment factors for road conditions and materials.

14. The motor vehicle according to claim 13, wherein the warning system issues a warning whenever the motor vehicle has passed the second approach point and a safe stopping distance retrieved by the warning system is greater than a distance to the first approach point.

15. The motor vehicle according to claim 14, wherein the safe stopping distance is retrieved as a function of vehicle speed.

16. The motor vehicle according to claim 13, wherein the traffic control information is uploaded from at least one of a database at a dealership, a database at a service center, a database at a manufacturing facility and a database accessible through the internet.

17. The motor vehicle according to claim 16, wherein the motor vehicle comprises a vehicle communication network and wherein the traffic control information can be updated from another motor vehicle using the vehicle communication network.

18. The motor vehicle according to claim 13, wherein the traffic control information can be exchanged between two or more vehicles.

19. The motor vehicle according to claim 13, wherein the traffic control information can be received wirelessly from a service location.

* * * * *